US005547828A

United States Patent [19]

Hioki et al.

[11] Patent Number: 5,547,828

[45] Date of Patent: Aug. 20, 1996

[54] DIRECT POSITIVE TYPE SILVER HALIDE PHOTOGRAPHIC MATERIAL COMPRISING A MIXTURE OF DYES

[75] Inventors: Takanori Hioki; Toyohisa Oya; Shingo Nishiyama, all of Kanagawa, Japan

[73] Assignee: Fuji Photo Film Co., Ltd., Kanagawa, Japan

[21] Appl. No.: 373,404

[22] Filed: Jan. 17, 1995

[30] Foreign Application Priority Data

Jan. 18, 1994 [JP] Japan ..... 6-003664
Jan. 18, 1994 [JP] Japan ..... 6-003665

[51] Int. Cl.[6] ..... G03C 1/36

[52] U.S. Cl. ..... 430/597; 430/606; 430/940

[58] Field of Search ..... 430/587, 588, 430/593, 595, 596, 597, 598, 606, 940

[56] References Cited

U.S. PATENT DOCUMENTS

| | | | |
|---|---|---|---|
| 3,431,111 | 3/1969 | Brooker et al. | 96/106 |
| 3,868,256 | 2/1975 | Sato et al. | 430/593 |
| 5,314,799 | 5/1994 | Takagi | 430/596 |

*Primary Examiner*—Janet C. Baxter
*Attorney, Agent, or Firm*—Sughrue, Mion, Zinn, MacPeak & Seas

[57] ABSTRACT

A direct positive type silver halide photographic material is described, which contains at least one compound represented by the following formula (I) and at least one cyanine dye having a pyrazolo[5,1-b]quinazolone nucleus and a cyanine heterocycle nucleus, wherein a carbon atom at 3-position of the pyrazolo[5,1-b]quinazolone nucleus is bonded through a four-methine chain to an atom at the 2-position or 4-position of the cyanine heterocycle nucleus, provided that the 4-position is possible only when the cyanine heterocycle nucleus is a quinoline or pyridine nucleus:

(I)

wherein $R_1$, $R_2$, $R_3$ and $R_4$ each represents an alkyl group, an aryl group or a heterocyclic group, which may be substituted; $V_1$, $V_2$, $V_3$, $V_4$, $V_5$, $V_6$, $V_7$ and $V_8$ each represents a hydrogen atom or a monovalent substituent; $L_1$, $L_2$ and $L_3$ each represents a substituted or unsubstituted methine group; $M_1$ represents a charge-neutralizing counter ion; and $m_1$ is a number of 0 or larger necessary for intramolecular charge neutralization.

12 Claims, No Drawings

DIRECT POSITIVE TYPE SILVER HALIDE PHOTOGRAPHIC MATERIAL COMPRISING A MIXTURE OF DYES

FIELD OF THE INVENTION

The present invention relates to a direct positive type silver halide photographic material. More particularly, the present invention relates to a direct positive type silver halide photographic material having high reversal sensitivity and reduced in residual coloring, and to a direct positive type silver halide photographic material having high reversal sensitivity and giving a high-quality image.

BACKGROUND OF THE INVENTION

Direct positive type silver halide photographic materials for use in applications such as micro COM recorders and lasers for printing have been remarkably developed in recent years. In the field of micro COM, for example, a product for COM recorders employing an He-Ne laser has come into use.

The red-sensitive desensitizing dyes used for such a purpose tend to have impaired reversal sensitivity because the ability of the dye hole to bleach an Ag nucleus is reduced. Hence, a direct positive type silver halide photographic material having good reversal sensitivity to red light has been strongly desired.

A direct positive type silver halide photographic material which is reduced in residual coloring after processing has also been strongly desired.

Although the cyanine dye having a pyrazolo[5,1-b] quinazolone nucleus which dye is used in the present invention is known as described in JP-A-49-29828, all the dye examples given in this reference have a structure in which the methine chain consists of two methine groups and are spectrally sensitized only in the orthochromatic region. (The term "JP-A" as used herein means an "unexamined published Japanese patent application.") The dye used in the present invention has four methine chains and differs from those dyes in that it can be spectrally sensitized in the panchromatic region.

In addition, although dyes similar to the dye represented by formula (I) used in the present invention are described in U.S. Pat. No. 3,431,111 and others, no technique is known which employs a dye combination such as that in the present invention.

Further, since higher processing rates are desirable for photographic materials in such a field, the conveying speed of the photographic materials tends to increase more and more recently. Increased conveying speeds result in increased contact forces between the film (photographic material) and the conveyor rollers. As a result, the film is charged to become apt to attract a foreign substance such as dust particles. If a film to which dust particles are adherent is exposed as it is, this causes problems of pinhole generation and partial sensitization of the film by electrical discharge.

On the other hand, various dyes are often used for the purpose of preventing silver halide photographic materials from suffering halation or irradiation to heighten image sharpness. However, dye selection is difficult because many of these dyes adversely influence the residual colors of processed films.

SUMMARY OF THE INVENTION

An object of the present invention is to provide a direct positive type silver halide photographic material having high reversal sensitivity and reduced in residual coloring.

This and other objects of the present invention have been accomplished with the following embodiment (A-1), (A-2) or (A-3):

(A-1) a direct positive type silver halide photographic material containing at least one compound represented by the following formula (I) and at least one cyanine dye having a pyrazolo[5,1-b]quinazolone nucleus and a cyanine heterocycle nucleus, wherein a carbon atom at the 3-position of the pyrazolo[5,1-b]quinazolone nucleus is bonded through a four-methine chain to an atom at the 2-position or 4-position of the cyanine heterocycle nucleus, provided that the 4-position is possible only when the cyanine heterocycle nucleus is a quinoline or pyridine nucleus:

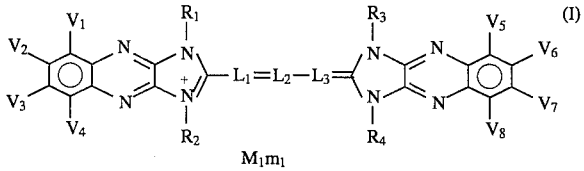

(I)

wherein $R_1$, $R_2$, $R_3$ and R4 are the same or different and each represents a substituted or unsubstituted alkyl group, a substituted or unsubstituted aryl group, or a substituted or unsubstituted heterocyclic group; $V_1$, $V_2$, $V_3$, $V_4$, $V_5$, $V_6$, $V_7$ and $V_8$ are the same or different and each represents a hydrogen atom or a monovalent substituent; $L_1$, $L_2$ and $L_3$ are the same or different and each represents a substituted or unsubstituted methine group; $M_1$ represents a charge-neutralizing counter ion; and $m_1$ is a number of 0 or larger necessary for intramolecular charge neutralization;

(A-2) the direct positive type silver halide photographic material as described in (A-1), wherein the cyanine dye having a pyrazolo[5,1-b]quinazolone nucleus is a dye represented by the following formula (II):

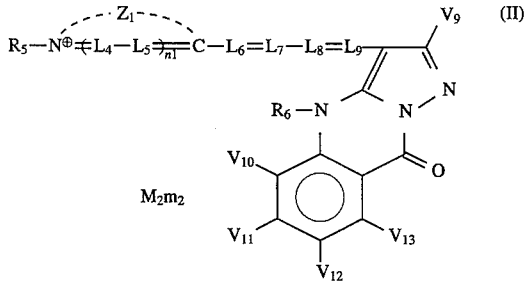

(II)

wherein $R_5$ and $R_6$ each has the same meaning as $R_1$, $R_2$, $R_3$ and $R_4$; $V_9$, $V_{10}$, $V_{11}$, $V_{12}$ and $V_{13}$ each has the same meaning as $V_1$, $V_2$, $V_3$, $V_4$, $V_5$, $V_6$, $V_7$ and $V_8$; $L_4$, $L_5$, $L_6$, $L_7$, $L_8$ and $L_9$ each has the same meaning as $L_1$, $L_2$ and $L_3$; $Z_1$ represents an atomic group necessary for forming a 5- or 6-membered nitrogen-containing heterocyclic ring; $M_2$ has the same meaning as $M_1$; $m_2$ has the same meaning as $m_1$; and $n_1$ is 0 or 1; or (A-3) the direct positive type silver halide photographic material as described in (A-1), which comprises a support having thereon an electrically conductive layer.

DETAILED DESCRIPTION OF THE INVENTION

The desensitizing dyes represented by formula (I) or (II) are described below in detail.

$V_1$, $V_2$, $V_3$, $V_4$, $V_5$, $V_6$, $V_7$, $V_8$, $V_9$, $V_{10}$, $V_{11}$, $V_{12}$ and $V_{13}$ are not particularly limited as long as they are each a hydrogen atom or a monovalent substituent. Examples thereof include a hydrogen atom, an unsubstituted alkyl group (e.g., methyl, ethyl, propyl, butyl), a substituted alkyl group (e.g., allyl, styryl, hydroxyethyl, trifluoromethyl, benzyl, sulfopropyl, diethylaminoethyl, cyanopropyl, adamantyl, p-chlorophenethyl, ethoxyethyl, ethylthioethyl, phenoxyethyl, carbamoylethyl, carboxyethyl, ethoxycarbonylmethyl, acetylaminoethyl), an unsubstituted aryl group (e.g., phenyl, naphthyl), a substituted aryl group (e.g., p-carboxyphenyl, 3,5-dicarboxyphenyl, m-sulfophenyl, p-acetamidophenyl, 3-caprylamidophenyl, p-sulfamoylphenyl, m-hydroxyphenyl, p-nitrophenyl, 3,5-dichlorophenyl, p-anisyl, o-anisyl, p-cyanophenyl, p-N-methylureidophenyl, m-fluorophenyl, p-tolyl, m-tolyl), an unsubstituted heterocyclic group (e.g., pyridyl, thienyl), a substituted heterocyclic group (e.g., 5-methyl-2-pyridyl), a halogen atom (e.g., chlorine, bromine, fluorine), a mercapto group, a cyano group, a carboxyl group, a sulfo group, a hydroxyl group, a carbamoyl group, a sulfamoyl group, an amino group, a nitro group, a substituted or unsubstituted alkoxy group (e.g., methoxy, ethoxy, 2-methoxyethoxy, 2-phenylethoxy), a substituted or unsubstituted aryloxy group (e.g., phenoxy, p-methylphenoxy, p-chlorophenoxy, α-naphthoxy), a substituted or unsubstituted acyl group (e.g., acetyl, benzoyl), a substituted or unsubstituted acylamino group (e.g., acetylamino, caproylamino), a substituted or unsubstituted sulfonyl group (e.g., methanesulfonyl, benzenesulfonyl), a substituted or unsubstituted sulfonylamino group (e.g., methanesulfonylamino, benzenesulfonylamino), a substituted amino group (e.g., diethylamino, hydroxyamino), a substituted or unsubstituted alkylthio or arylthio group (e.g., methylthio, carboxyethylthio, sulfobutylthio, phenylthio), a substituted or unsubstituted alkoxycarbonyl group (e.g., methoxycarbonyl), and a substituted or unsubstituted aryloxycarbonyl group (e.g., phenoxycarbonyl).

These substituents may be further substituted by one or more of an alkyl group, an alkenyl group, an aryl group, a hydroxyl group, a carboxyl group, a sulfo group, a nitro group, a cyano group, a halogen atom, an alkoxy group, an aryloxy group, an alkoxycarbonyl group, an acyl group, an acylamino group, a sulfonamino group, a carbamoyl group and a sulfamoyl group.

$V_9$ is preferably an unsubstituted alkyl group (e.g., methyl, ethyl, t-butyl) or an unsubstituted aryl group (e.g., phenyl), more preferably a methyl group or an ethyl group, and most preferably a methyl group.

$V_1$, $V_2$, $V_3$, $V_4$, $V_5$, $V_6$, $V_7$, $V_8$, $V_{10}$, $V_{11}$, $V_{12}$ and $V_{13}$ are each preferably a hydrogen atom or an electron-attracting group, more preferably a hydrogen atom. The electron-attracting group means a group having a Hammett's $\sigma_P$ value higher than zero. With respect to $\sigma_P$, reference may be made, for example, to Kozo Kassei Sokan Konwa Kai (Structure/Activity Correlation Gathering), *Kagaku No Ryoiki* (*The Domain of Chemistry*), zokan (extra issue) No. 122, "Yakubutsu No Kozo Kassei Sokan (Structure/Activity Correlation for Drags)—Drag Design To Sayo Kisa Kenkyu E No Shishin (Guide to Drug Design and Function/Mechanism Investigation)," pp. 96–103, Nankodosha; Corwin Hansch and Albert Leo, *Substituent Constants for Correlation Analysis in Chemistry and Biology,* pp. 69–161, John Wiley and Sons; and Corwin Hansch, A. Leo and R. W. Taft, *Chemical Reviews,* Vol. 91, pp. 165–195 (1991). The $\sigma_P$ values of substituents whose $\sigma_P$ values have been unknown can be determined by the method described in *Chemical Reviews,* Vol. 17, pp. 125–136 (1935).

Examples thereof include a hydrogen atom, a halogen atom (e.g., chlorine, bromine, fluorine, iodine), a nitro group, a cyano group, an acyl group (e.g., acetyl, benzoyl), a sulfonyl group (e.g., methanesulfonyl, benzenesulfonyl), an alkoxycarbonyl group (e.g., methoxycarbonyl), an aryloxycarbonyl group (e.g., phenoxycarbonyl), and a trifluoromethyl group.

Preferred examples of $R_1$, $R_2$, $R_3$, $R_4$, $R_5$ and $R_6$ include an unsubstituted alkyl group having from 1 to 18 carbon atoms (e.g., methyl, ethyl, propyl, butyl, pentyl, octyl, decyl, dodecyl, octadecyl), a substituted alkyl {alkyl groups having from 1 to 18 carbon atoms and substituted by one or more substituents, which is not particularly limited and examples thereof include a carboxyl group, a sulfo group, a cyano group, a halogen atom (e.g., fluorine, chlorine, bromine), a hydroxyl group, an alkoxycarbonyl group having from 2 to 8 carbon atoms (e.g., methoxycarbonyl, ethoxycarbonyl, benzyloxycarbonyl), an alkanesulfonylaminocarbonyl group having from 2 to 8 carbon atoms, an acylaminosulfonyl group having from 2 to 8 carbon atoms, an alkoxy group having from 1 to 8 carbon atoms (e.g., methoxy, ethoxy, benzyloxy, phenethyloxy), an alkylthio group having from 1 to 8 carbon atoms (e.g., methylthio, ethylthio, methylthioethylthioethyl), an aryloxy group having from 6 to 20 carbon atoms (e.g., phenoxy, p-tolyloxy, 1-naphthoxy, 2-naphthoxy), an acyloxy group having from 1 to 3 carbon atoms (e.g., acetyloxy, propionyloxy), an acyl group having from 1 to 8 carbon atoms (e.g., acetyl, propionyl, benzoyl), a carbamoyl group (e.g., carbamoyl, N,N-dimethylcarbamoyl, morpholinocarbonyl, piperidinocarbonyl), a sulfamoyl group (e.g., sulfamoyl, N,N-dimethylsulfamoyl, morpholinosulfonyl, piperidinosulfonyl), and an aryl group having from 6 to 20 carbon atoms (e.g., phenyl, 4-chlorophenyl, 4-methylphenyl, α-naphthyl); these substituents may be further substituted by one or more of the above-described substituents}, an unsubstituted aryl group (e.g., phenyl, 2-naphthyl, 1-naphthyl), a substituted aryl group (e.g., any groups substituted by those enumerated above as examples of $V_1$ to $V_{13}$), an unsubstituted heterocyclic group (e.g., 2-pyridyl, 2-thiazolyl, 2-furyl), and a substituted heterocyclic group (e.g., heterocyclic group substituted by mentioned above as an example of $V_1$ to $V_{13}$).

Preferable examples of $R_1$ to $R_6$ are an unsubstituted alkyl group (e.g., methyl, ethyl, n-propyl, n-butyl, n-pentyl, n-hexyl) and a substituted alkyl group (e.g., 2-carboxyethyl, carboxymethyl, 2-sulfoethyl, 3-sulfopropyl, 4-sulfobutyl, 3-sulfopropyl, methanesulfonylcarbamoylmethyl, allyl, benzyl). $R_1$ to $R_5$ are each more preferably an allyl group or a benzyl group, and most preferably a benzyl group. $R_6$ is more preferably a methyl group.

Examples of the nucleus formed by Z1 include a thiazole nucleus [for example, a thiazole nucleus (e.g., thiazole, 4-methylthiazole, 4-phenylthiazole, 4,5-dimethylthiazole, 4,5-diphenylthiazole, 3,4-dihydronaphtho[4,5-a]thiazole), a benzothiazole nucleus (e.g., benzothiazole, 4-chlorobenzothiazole, 5-chlorobenzothiazole, 6-chlorobenzothiazole, 5-nitrobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-ethoxycarbonylbenzothiazole, 5-phenoxybenzothiazole, 5-carboxybenzothiazole, 5-acetylbenzothiazole, 5-acetoxybenzothiazole, 5-phenethylbenzothiazole, 5-fluorobenzothiazole, 5-trifluoromethylbeznothiazole, 5-chloro-6-methylbenzothiazole, 5,6-dimethylbenzothiazole, 5,6-dimethoxybenzothiazole, 5,6-methylenedioxybenzothiazole, 5-hydroxy-6-methylbenzothiazole, tetrahydrobenzothiazole, 4-phenylbenzothiazole, 5,6-bismethylthiobenzothiazole), a naphthothiazole nucleus (e.g., naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 5-methoxynaptho[2,3-d] thiazole, 8-methylthionaphtho[1,2-d]thiazole)], a thiazoline nucleus (for example, thiazoline, 4-methylthiazoline, 4-nitrothiazoline), an oxazole nucleus [for example, an oxazole nucleus (e.g., oxazole, 4-methyloxazole, 4-nitroxazole, 5-methyloxazole, 4-phenyloxazole, 4,5-diphenyloxazole, 4-ethyloxazole), a benzoxazole nucleus (e.g., benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, 5-ethoxybenzoxazole, 5-acethylbenzoxazole), a naphthoxazole nucleus (e.g., naphtho[2,1-d]oxazole, naphtho[1,2-d]oxazole, naphtho[2,3-d]oxazole, 5-nitronaphtho[2,1-d]oxazole)], an oxazoline nucleus ( for example, 4,4-dimethyloxazoline), a selenazole nucleus [for example, a selenazole nucleus (e.g., 4-methylselenazole, 4-nitroselenazole, 4-phenylselenazole), a benzoselenazole nucleus (e.g., benzoselenazole, 5-chlorobenzoselenazole, 5-nitrobenzoselenazole, 5-methoxybenzoselenazole, 5-hydroxybenzoselenazole, 6-nitrobenzoselenazole, 5-chloro-6-nitrobenzoselenazole, 5,6-dimethylbenzoselenazole), a naphthoselenazole nucleus (e.g., naphtho[2,1-d]selenazole, naphtho[1,2-d]selenazole)], a selenazoline nucleus (for example, selenazoline, 4-methylselenazoline), a tellurazole nucleus [for example, a tellurazole nucleus (e.g., tellurazole, 4-methyltellurazole, 4-phenyltellurazole), a benzotellurazole nucleus (e.g., benzotellurazole, 5-chlorobenzotellurazole, 5-methylbenzotellurazole, 5,6-dimethylbenzotellurazole, 6-methoxybenzotellurazole), a naphthotellurazole nucleus (e.g., naphtho[2,1-d]tellurazole, naphtho[1,2-d]tellurazole)], a tellurazoline nucleus (for example, tellurazoline, 4-methyltellurazoline), a 3,3-dialkylindolenine nucleus (for example, 3,3-dimethylindolenine, 3,3-diethylindolenine, 3,3-dimethyl- 5-cyanoindolenine, 3,3-dimethyl-6-nitroindolenine, 3,3-dimethyl-5-nitroindolenine 3,3-dimethyl-5-methoxyindolenine, 3,3,5-trimethylindolenine, 3,3-dimethyl-5-chloroindolenine), an imidazole nucleus [for example, an imidazole nucleus (e.g., 1-alkylimidazole, 1-alkyl-4-phenylimidazole, 1-arylimidazole), a benzimidazole nucleus (e.g., 1-alkylbenzimidazole, 1-alkyl-5-chlorobenzimidazole, 1-alkyl-5,6-dichlorobenzimidazole, 1-alkyl-5-methoxybenzimidazole, 1-alkyl-5-cyanobenzimidazole, 1-alkyl-5-fluorobenzimidazole, 1-alkyl- 5-trifluoromethylbenzimidazole, 1-alkyl-6-chloro-5-cyanobenzimidazole, 1-alkyl-6-chloro-5-trifluoromethylbenzimidazole, 1-allyl-5,6-dichlorobenzimidazole, 1-allyl-5-chlorobenzimidazole, 1-arylbenzimidazole, 1-aryl-5-chlorobenzimidazole, 1-aryl-5,6-dichlorobenzimidazole, 1-aryl- 5-methoxybenzimidazole, 1-aryl-5-cyanobenzimidazole), a naphthimidazole nucleus (e.g., 1-alkylnaphtho[1,2-d]imidazole, 1-arylnaphtho[1,2-d]imidazole), wherein the alkyl group as a substituent on the above-described nucleus has preferably from to 8 carbon atoms such as an unsubstituted alkyl group (e.g., methyl, ethyl, propyl, isopropyl, butyl) and a hydroxyalkyl group (e.g., 2-hydroxyethyl, 3-hydroxypropyl), and more preferably a methyl group or an ethyl group; and the aryl group as a substituent on the above-described nucleus represents an unsubstituted phenyl group, a phenyl group substituted by a halogen atom such as a chlorine atom, a phenyl group substituted by an alkyl group such as a methyl group, or an alkoxy group substituted by an alkoxy group such as a methoxy group], a pyridine nucleus (for example, 2-pyridine, 4-pyridine, 5-methyl-2-pyridine, 3-methyl-4-pyridine), a quinoline nucleus [for example, a quinoline nucleus (e.g., 2-quinoline, 3-methyl-2-quinoline, 5-ethyl-2-quinoline, 6-methyl-2-quinoline, 6-nitro-2-quinoline, 8-fluoro- 2-quinoline, 6-methoxy-2-quinoline, 6-hydroxy-2-quinoline, 8-chloro-2-quinoline, 4-quinoline, 6-ethoxy-4-quinoline, 6-nitro-4-quinoline, 8-chloro-4-quinoline, 8-fluoro- 4-quinoline, 8-methyl-4-quinoline, 8-methoxy-4-quinoline, 6-methyl-4-quinoline, 6-methoxy-4-quinoline, 6-chloro- 4-quinoline, 5,6-dimethyl-4-quinoline), an isoquinoline nucleus (e.g., 6-nitro-1-isoquinoline, 3,4-dihydro-1-isoquinoline, 6-nitro-3-isoquinoline)], an imidazo[4,5-b]quinoxaline nucleus (for example, 1,3-diethylimidazo[4,5-b]quinoxaline, 6-chloro-1,3-diallylimidazo [4,5-b]quinoxaline, 6-chloro-1,3-dibenzylimidazo[4,5-b] quinoxaline, 6-chloro-1,3-diphenylimidazo[4,5-b] quinoxaline, 6-nitro-1,3-diallylimidazo[4,5-b]quinoxaline), an oxadiazole nucleus, a thiadiazole nucleus, a tetrazole nucleus, a pyrimidine nucleus, an imidazo[4,5-b]pyrazine nucleus (for example, 1,3-diethyl[4,5-b]pyrazine, 1,3-diallyl [4,5-b]pyrazine), an imidazo[4,5-b]1,4-quinone nucleus (for example, 1,3-diethyl[4,5-b]1,4-quinone), a pyrrolopyridine nucleus, a pyrazolopyridine nucleus, a 1,3,3a,7-tetrazaindene nucleus, an indenone nucleus, an indolizine nucleus, and a 1,8-naphthilizine nucleus.

The nucleus formed by $Z_1$ is more preferably an imidazo [4,5-b]quinoxaline nucleus or an indolenine nucleus, and most preferably an imidazo[4,5-b]quinoxaline nucleus.

Especially preferred examples of the imidazo[4,5-b]quinoxaline nucleus are represented by the following formula (LA):

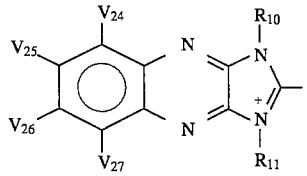

(LA)

In formula (LA), $R_{10}$ and $R_{11}$ are the same or different and each has the same meaning as $R_1$ to $R_6$, and preferred examples of $R_{10}$ and $R_{11}$ are the same as those of $R_1$ to $R_6$. Especially preferred is an aryl-substituted methyl group (e.g., benzyl).

$V_{22}$, $V_{25}$, $V_{26}$, and $V_{27}$ are the same or different and each has the same meaning as $V_1$ to $V_{13}$, and preferred examples of $V_{24}$ to $V_{27}$ are the same as those of $V_1$ to $V_{13}$. Especially preferred are a hydrogen atom and the electron-attracting group enumerated as examples of $V_1$ to $V_8$ and $V_{10}$ to $V_{13}$.

$L_1$, $L_2$, $L_3$, $L_4$, $L_5$, $L_6$, $L_7$, $L_8$, and $L_9$ each represents a methine group or a substituted methine group {e.g., methine groups substituted by a substituted or unsubstituted alkyl group (e.g., methyl, ethyl, 2-carboxyethyl), a substituted or unsubstituted aryl group (e.g., phenyl, o-carboxyphenyl), a substituted or unsubstituted heterocyclic group (e.g., barbituric acid), a halogen atom (e.g., chlorine, bromine), a substituted or unsubstituted alkoxy group (e.g., methoxy, ethoxy), a substituted or unsubstituted amino group (e.g., N,N-diphenylamino, N-methyl-N-phenylamino, N-methylpiperazino), or a substituted or unsubstituted alkylthio group (e.g., methylthio, ethylthio), which may be further substituted by one or more of these substituents}. Each of $L_1$ to $L_9$ may form a ring together with another methine group or with an auxochrome. $L_1$ to $L_9$ are each preferably an unsubstituted methine group.

$M_1m_1$ and $M_2m_2$ are each included in the formula for the purpose of indicating the presence or absence of a cation or anion in the case where the ion is necessary for neutralizing an ionic charge of the dye.

Whether a given dye is a cation or an anion or whether it has a clear charge or not depends on the auxochrome(s) and substituent(s) thereof. Typical cations are an inorganic or organic ammonium ion (e.g., tetraalkylammonium ion, pyridinium ion), an alkali metal ion (e.g., sodium ion, potassium ion), and an alkaline earth metal ion (e.g., calcium ion). On the other hand, the anion may be either inorganic or organic, and examples thereof include a halogen anion (e.g., fluorine ion, chlorine ion, bromine ion, iodine ion), a substituted arylsulfonate ion (e.g., p-toluenesulfonate ion, p-chlorobenzenesulfonate ion), an aryldisulfonate ion (e.g., 1,3-benzenedisulfonate ion, 1,5-naphthalenedisulfonate ion, 2,6-naphthalenedisulfonate ion), an alkylsulfate ion (e.g., methylsulfate ion, ethylsulfate ion), a sulfate ion, a thiocyanate ion, a perchlorate ion, a tetrafluoroborate ion, a picrate ion, an acetate ion, a trifluoromethanesulfonate ion, and a hexafluorophosphate ion.

The charge-neutralizing counter ion may be an ionic polymer or a dye having an opposite charge to the dye, or may be a metal complex ion (e.g., bisbenzene-1,2-dithiolatonickel(III)).

$M_1$ and $M_2$ are each preferably a sodium ion, a potassium ion, a triethylammonium ion, a pyridinium ion, an iodine ion, a p-toluenesulfonate ion, a methanesulfonate ion, or a chlorine ion, and more preferably a chlorine ion or a methanesulfonate ion.

Each of $m_1$ and $m_2$ is preferably 1.

Typical examples of the compounds for use in the present invention are given below, but the compounds should not be construed as being limited thereto.

a) Examples of the compound represented by formula (I):

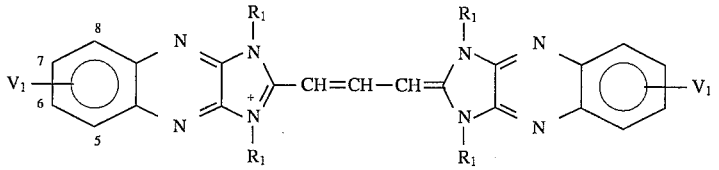

Mm

| Compound No. | $R_1$ | $V_1$ | M | m |
|---|---|---|---|---|
| I-1 | $CH_2CH=CH_2$ | 6-Cl | $PTS^-$ | 1 |
| I-2 | $CH_2CH=CH_2$ | 6-$CF_3$ | $PTS^-$ | 1 |
| I-3 | $CH_2CH=CH_2$ | 6-$NO_2$ | $PTS^-$ | 1 |
| I-4 | $CH_2CH=CH_2$ | 6-Cl, 7-Cl | $PTS^-$ | 1 |
| I-5 | $CH_2CH=CH_2$ | 6-$SO_2Ph$ | $PTS^-$ | 1 |
| I-6 | $CH_2CH=CH_2$ | 6-CN | $PTS^-$ | 1 |
| I-7 | $CH_2CH=CH_2$ | H | $PTS^-$ | 1 |
| I-8 | $CH_2CH=CH_2$ | 6-$CH_3$, 7-$CH_3$ | $PTS^-$ | 1 |
| I-9 | $C_2H_5$ | 6-Cl | $I^-$ | 1 |
| I-10 | $(CH_2)_2Ph$ | 6-Cl | $PTS^-$ | 1 |
| I-11 | Ph | 6-Cl | $PTS^-$ | 1 |
| I-12 | $(CH_2)_2OC_2H_5$ | 6-Cl, 7-Cl | $PTS^-$ | 1 |
| I-13 | $(CH_2)_2SCH_3$ | 6-Cl | $PTS^-$ | 1 |
| I-14 | $CH_2CO_2H$ | 6-Cl | $Br^-$ | 1 |
| I-15 | $CH_2CONHSO_2CH_3$ | 6-Cl | $Br^-$ | 1 |
| I-16 | $(CH_2)_4SO_3^-$ | 6-Cl | $Na^+$ | 3 |
| I-17 | $(CH_2)_2OH$ | 6-$CF_3$ | $I^-$ | 1 |
| I-18 | $(CH_2)_2CN$ | H | $I^-$ | 1 |
| I-19 | $(CH_2)_4CH_3$ | 6-$OCH_3$, 7-$OCH_3$ | $I^-$ | 1 |
| I-20 | $(CH_2)_2Ph$ | H | $Br^-$ | 1 |
| I-21 | $(CH_2)_2OPh$ | 6-Cl | $PTS^-$ | 1 |
| I-22 | $(CH_2)_2SPh$ | 6-Br | $PTS^-$ | 1 |
| I-23 | $(CH_2)_2CONHPh$ | 6-I | $PTS^-$ | 1 |
| I-24 | $(CH_2)_2O(CH_2)_2OCH_3$ | 6-Cl | $PTS^-$ | 1 |
| I-25 | $CH_2CH=CH_2$ | 6-$SO_2CH_3$ | $PTS^-$ | 1 |
| I-26 | $CH_2CH=CH_2$ | 6-COPh | $PTS^-$ | 1 |
| I-27 | $CH_2CH=CH_2$ | 6-$COCH_3$ | $PTS^-$ | 1 |
| I-28 | $CH_2CH=CH_2$ | 6-$CO_2C_2H_5$ | $PTS^-$ | 1 |
| I-29 | $CH_2CH=CH_2$ | 6-$CONHCH_3$ | $PTS^-$ | 1 |

-continued
(I-30)
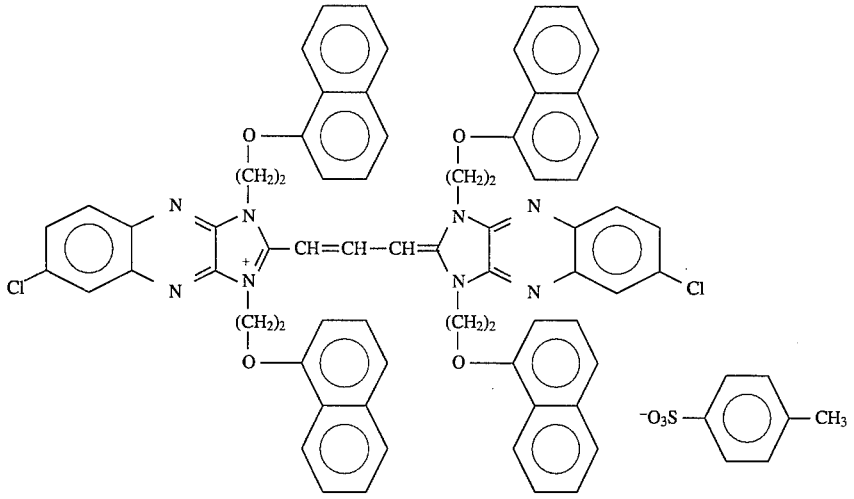
(I-31)
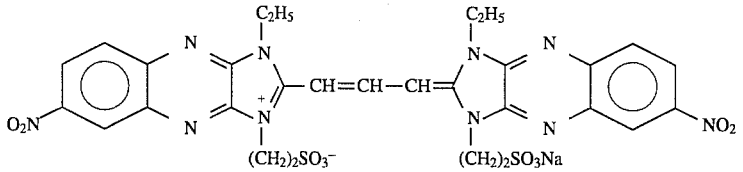
(I-32)
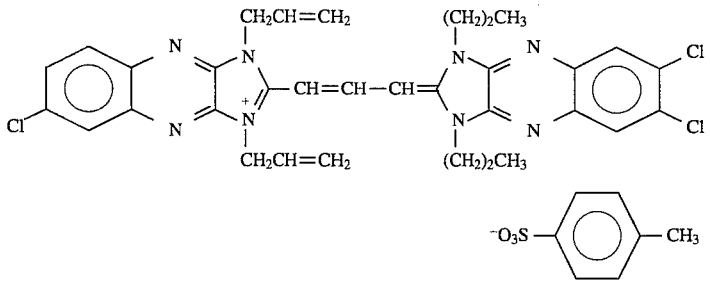
(I-33)
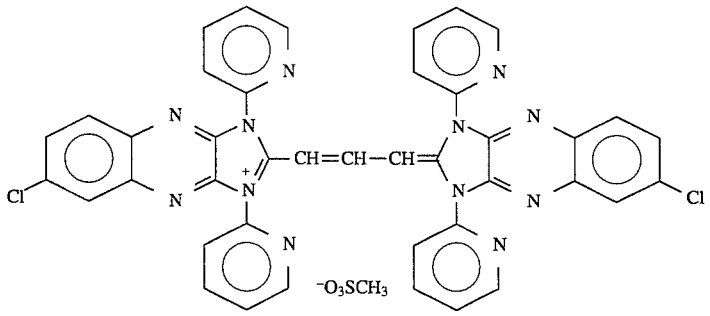
(I-34)
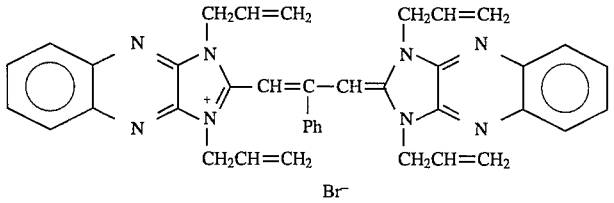

-continued

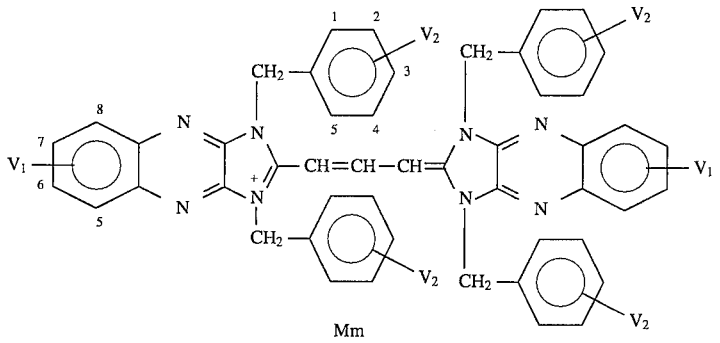

Mm

| Compound No. | $V_1$ | $V_2$ | M | m |
|---|---|---|---|---|
| I-35 | H | H | $MeSO_3^-$ | 1 |
| I-36 | H | H | $PTS^-$ | 1 |
| I-37 | H | H | $Cl^-$ | 1 |
| I-38 | H | H | $Br^-$ | 1 |
| I-39 | H | H | $HSO_3^-$ | 1 |
| I-40 | H | H | $SO_2^{2-}$ | 0.5 |
| I-41 | 6-Cl | H | $MeSO_3^-$ | 1 |
| I-42 | 6-$CF_3$ | H | $MeSO_3^-$ | 1 |
| I-43 | 6-CN | H | $MeSO_3^-$ | 1 |
| I-44 | H | 3-Cl | $MeSO_3^-$ | 1 |
| I-45 | H | 3-OMe | $MeSO_3^-$ | 1 |
| I-46 | H | 3-$NO_2$ | $MeSO_3^-$ | 1 |
| I-47 | H | 2-$NO_2$ | $MeSO_3^-$ | 1 |
| I-48 | H | 1-$NO_2$, 3-$NO_2$ | $MeSO_3^-$ | 1 |

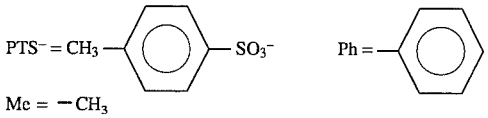

Me = $-CH_3$ b) Examples of the compound represented by formula (II) (these compounds are described as Chem. 11 to Chem. 25 in JP-A-6-228446, from p.13, paragraph [0018] to p.25, paragraph [0036]):

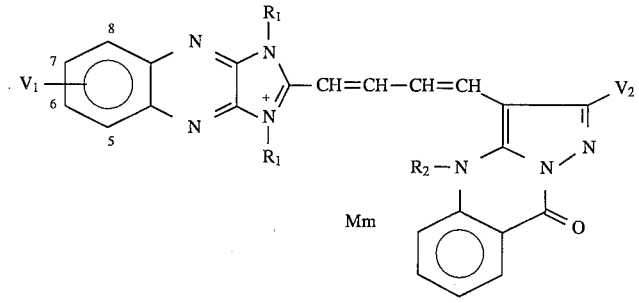

Mm

| Compound No. | $R_1$ | $R_2$ | $V_1$ | $V_2$ | M | m |
|---|---|---|---|---|---|---|
| II-1 | $CH_2CH=CH_2$ | Me | H | Me | $PTS^-$ | 1 |
| II-2 | $CH_2Ph$ | Me | H | Me | $PTS^-$ | 1 |
| II-3 | $CH_2Ph$ | Me | H | Me | $MeSO_3^-$ | 1 |
| II-4 | $CH_2CH=CH_2$ | Me | 6-OMe, 7-OMe | Me | $PTS^-$ | 1 |
| II-5 | Ph | Me | H | Ph | $I^-$ | 1 |
| II-6 | $(CH_2)_2CO_2H$ | Et | H | Et | $I^-$ | 1 |
| II-7 | $(CH_2)_2OMe$ | Me | 6-Me | Cl | $PTS^-$ | 1 |
| II-8 | $(CH_2)_2SMe$ | $(CH_2)_4Me$ | 6-OMe | OMe | $PTS^-$ | 1 |
| II-9 | $(CH_2)_2Ph$ | Me | 6,7-$OCH_2O-$ | Ph | $PTS^-$ | 1 |
| II-10 | $(CH_2)_2CN$ | $(CH_2)_4Me$ | H | Me | $PTS^-$ | 1 |
| II-11 | $CH_2C\equiv CH$ | Me | 5-Me | $(CH_2)_2OPh$ | $PTS^-$ | 1 |
| II-12 | $CH_2CO_2Et$ | Me | 5-Me, 8-Me | $CH_2Cl$ | $PTS^-$ | 1 |
| II-13 | $(CH_2)_2SO_3^-$ | Me | 6-Me, 7-Me | Ph | $Na^+$ | 1 |

-continued (II-14)

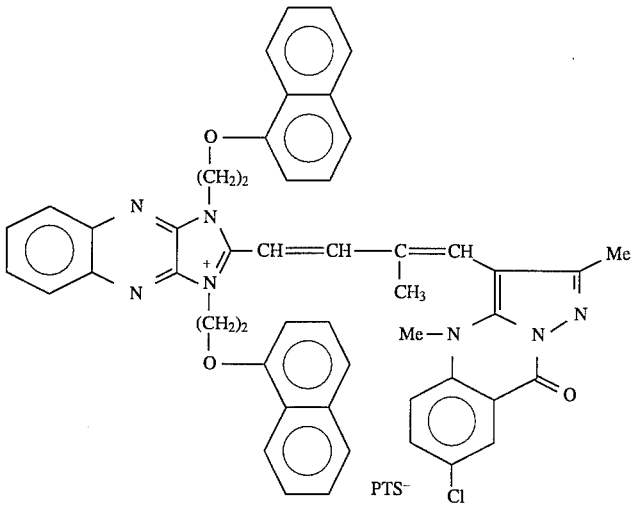

(II-15)

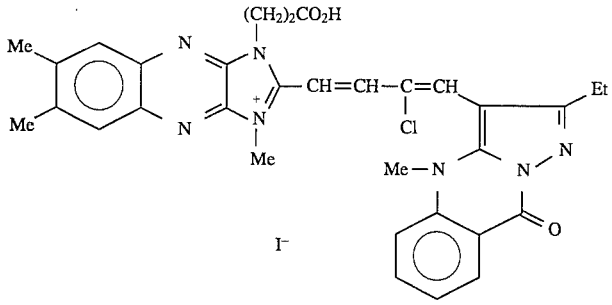

| | | | | | | |
|---|---|---|---|---|---|---|
| II-16 | $CH_2CH=CH_2$ | Me | 6-Cl | Me | $I^-$ | 1 |
| II-17 | $CH_2CH=CH_2$ | Me | 6-Cl | Me | $PTS^-$ | 1 |
| II-18 | $CH_2Ph$ | Me | 6-Cl | Me | $PTS^-$ | 1 |
| II-19 | $CH_2CH=CH_2$ | Me | 5-Cl | Me | $PTS^-$ | 1 |
| II-20 | Et | Me | 8-Cl | Me | $PTS^-$ | 1 |
| II-21 | $CH_2CH=CH_2$ | Me | 6-Cl, 7-Cl | Me | $PTS^-$ | 1 |
| II-22 | Et | Me | 6-Cl, 7-Cl | Me | $PTS^-$ | 1 |
| II-23 | $CH_2CH=CH_2$ | Me | 6-Br, 7-Br | Me | $PTS^-$ | 1 |
| II-24 | $CH_2CH=CH_2$ | Me | 6-Cl | Ph | $PTS^-$ | 1 |
| II-25 | Ph | Me | 6-Cl | Me | $PTS^-$ | 1 |
| II-26 | $CH_2CH=CH_2$ | Et | 6-$NO_2$ | Et | $Br^-$ | 1 |
| II-27 | $(CH_2)_2CO_2H$ | $(CH_2)_2Me$ | 6-CN | Cl | $I^-$ | 1 |
| II-28 | $CH_2CH=CH_2$ | Me | 6-$CO_2Me$ | Ph | $PTS^-$ | 1 |
| II-29 | $(CH_2)_2OMe$ | Et | 6-$CO_2Me$ | Et | $PTS^-$ | 1 |
| II-30 | $CH_2CH=CH_2$ | Me | 6-$SO_2Ph$ | Me | $PTS^-$ | 1 |
| II-31 | $(CH_2)_2SO_3^-$ | Me | 6-SOPh | Me | $Na^+$ | 1 |
| II-32 | $(CH_2)_2SMe$ | Et | 6-CONHMe | Ph | $PTS^-$ | 1 |
| II-33 | $CH_2CH=CH_2$ | Me | 6-COPh | Me | $PTS^-$ | 1 |
| II-34 | $(CH_2)_2CN$ | Et | 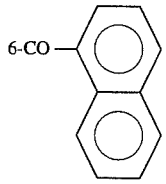 | Me | $PTS^-$ | 1 |
| II-35 | $CH_2CH=CH_2$ | Me | 6-I | Me | $PTS^-$ | 1 |
| II-36 | $(CH_2)_2Me$ | Me | 6-F | Et | $PTS^-$ | 1 |
| II-37 | $CH_2CONHSO_2Me$ | Me | 6-$CO_2Ph$ | Me | $Br^-$ | 1 |
| II-38 | $CH_2Ph$ | Me | 6-$CF_3$ | Me | $PTS^-$ | 1 |

-continued
(II-39)
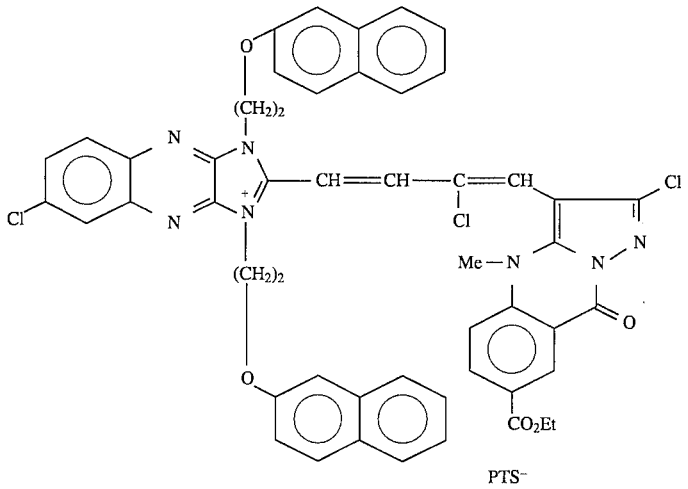
(II-40)
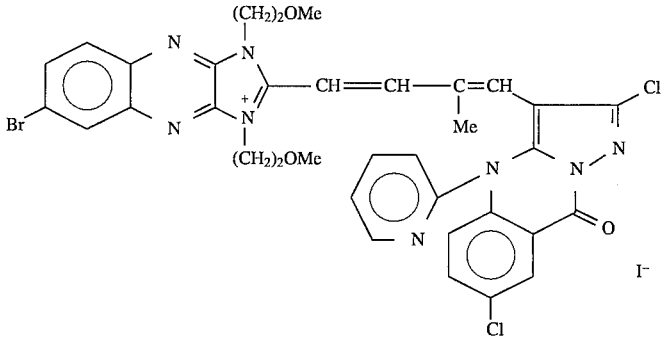
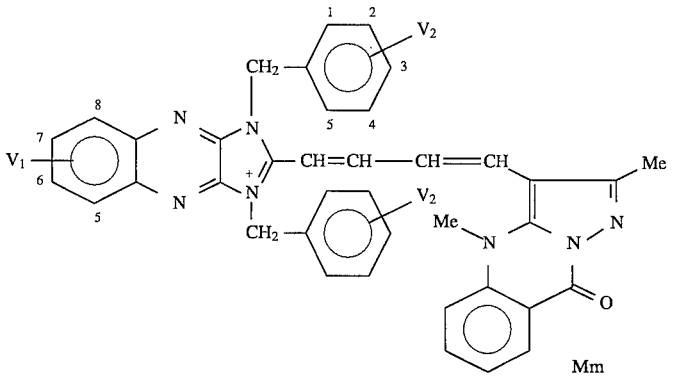
| Compound No. | $V_1$ | $V_2$ | M | m |
|---|---|---|---|---|
| II-41 | 6-$NO_2$ | 3-Cl | $MeSO_3^-$ | 1 |
| II-42 | 5-Me, 6-Me | 2-$NO_2$ | $MeSO_3^-$ | 1 |
| II-43 | H | 1-$NO_2$, 3-$NO_2$ | $MeSO_3^-$ | 1 |
| II-44 | H | H | $Cl^-$ | 1 |
| II-45 | H | H | $HSO_4^-$ | 1 |
(II-46)
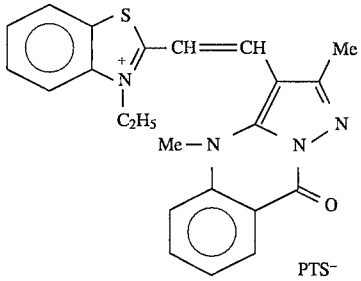

-continued
(II-47)
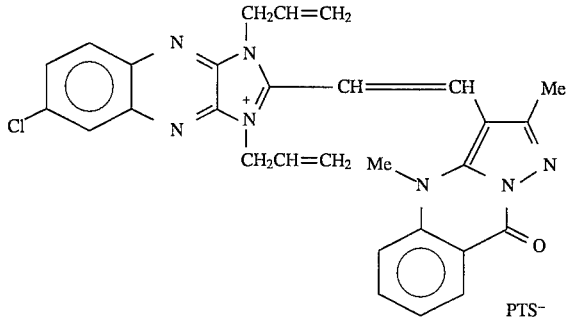
(II-48)
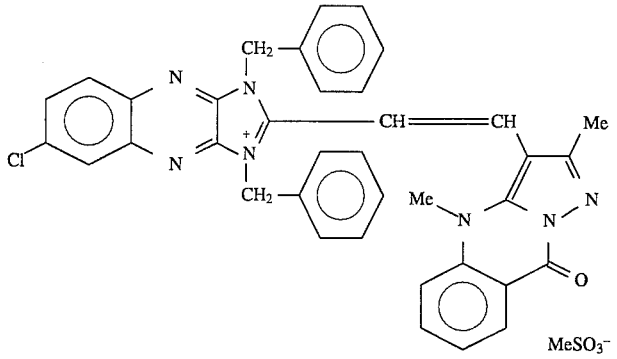
(II-49)
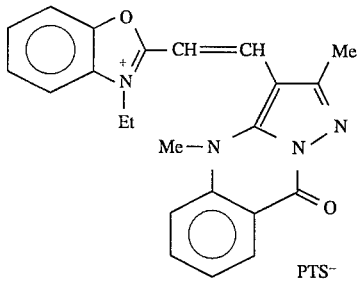
(II-50)
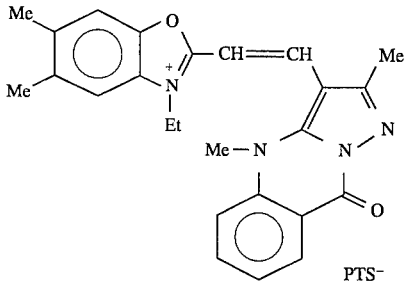
(II-51)
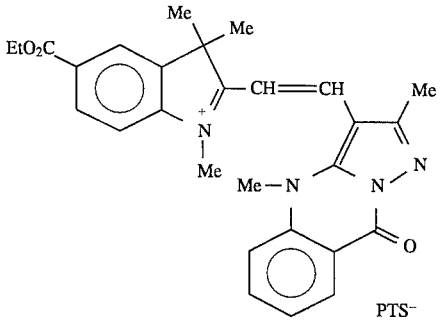

-continued (II-52)

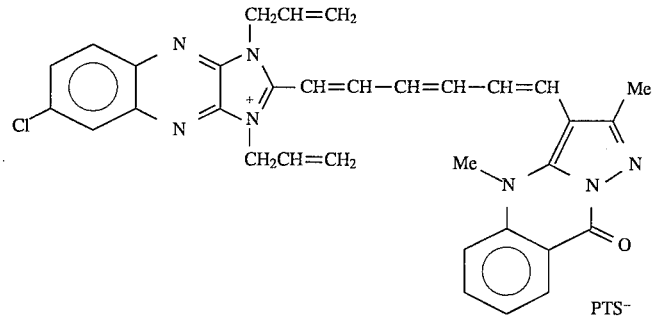

Et = $-C_2H_5$ $V_1$ of Compound No. II-9 means $-OCH_2O-$ bonded to the carbon atoms at the 6- and 7-positions.

These compounds enumerated above can be synthesized by, for example, the methods described in JP-A-6-228446; F. M. Hamer, *Heterocyclic Compounds—Cyanine Dyes and Related Compounds* (John Wiley & Sons, New York, London, 1964); D. M. Sturmer, *Heterocyclic Compounds—Special Topics in Heterocyclic Chemistry*, Chapter 18, Section 14, pp. 482–515, John Wiley & Sons, New York, London (1977); and *Rodd's Chemistry of Carbon Compounds* (2nd Ed. vol. IV, part B, 1977) Chapter 15, pp. 369–422, (2nd, Ed. vol. IV, part B, 1985) Chapter 15, pp. 267–296, Elsvier Science Publishing Company Inc., New York.

The photographic emulsion for use in the present invention may be spectrally sensitized with another methine dye or another dye together with the methine compound of the present invention. Examples of such dyes for use for this purpose include cyanine dyes, merocyanine dyes, composite cyanine dyes, composite merocyanine dyes, holopolar cyanine dyes, hemicyanine dyes, styryl dyes, and hemioxonol dyes. Especially useful dyes are cyanine dyes, merocyanine dyes, and composite merocyanine dyes.

The composition, appearance of crystals, size, and other properties of the silver halide of the photographic emulsion for use in the present invention may be any of known ones.

5- A detailed explanation thereof is given, for example, in JP-A-2-269334, from p. 19, right upper column, line 17 to p. 20, right upper column, line 7.

In the present invention, a direct positive type silver halide emulsion which has been fogged beforehand (hereinafter referred to as "pre-fogged") is used.

The silver halide emulsion for use in the present invention may be produced by any of an acid process, a neutral process, and an ammonia process. Examples of the silver halide include silver bromide, silver chloride, silver chlorobromide, silver iodobromide, and silver chloroiodobromide.

The silver halide grains for use in the present invention preferably have an average grain diameter of from 0.40 to 0.10 μm. The grain size frequency distribution may be either wide or narrow, but it is preferably narrow. Especially preferred is a so-called mono-disperse emulsion in which 90% by number, preferably 95% by number, of all grains have a grain size within the range of ±40%, preferably ±20%, of the average grain size thereof. The silver halide grains may have a uniform crystal habit or a combination of different crystal habits, but preferably have a uniform crystal habit.

The silver halide for use in the present invention preferably has a grain size of from 0.06 to 0.12 μm.

The fogging of the direct positive type silver halide for use in the present invention is preferably conducted using a conventionally known technique after the silver halide is formed by precipitation and the water-soluble salts generated are removed. This fogging may be performed with a fogging agent (reducing agent) alone or a combination of a fogging agent and either a gold compound or a compound of a useful metal which is electrically more positive than silver.

Representative examples of fogging agents useful for emulsion production include formalin, hydrazine, polyamines (e.g., triethylenetetramine and tetraethylenepentamine), thiourea dioxide, tetra(hydroxymethyl)phosphonium chloride, amine borane boron hydride compounds, stannous chloride, and tin(II) chloride. Representative examples of the compound of a useful metal which is electrically more positive than silver include soluble salts of, for example, gold, rhodium, platinum, palladium, or iridium, such as potassium chloroaurate, chloroauric acid, ammonium palladium chloride, and sodium iridium chloride.

The fogging agent is used preferably in an amount of from $1.0\times10^{-6}$ to $1.0\times10^{-1}$ mol per mol of the silver halide.

Representative examples of the gold compound include chloroauric acid, sodium chloroaurate, gold sulfide, and gold selenide. Such a gold compound is preferably incorporated preferably in an amount of from $1.0\times10^{-8}$ to $1.0\times10^{-4}$ mol per mol of the silver halide.

The degree of fogging of the pre-fogged direct positive type silver halide emulsion for use in the present invention can be varied widely. As is well known to artisans, this degree of fogging varies depending not only on the silver halide composition, grain size, and the like of the silver halide emulsion used, but also on the kind and concentration of the fogging agent used, the pH, pAg, and temperature of the emulsion at the time of fogging, the duration, and the like.

Other various additives for general photographic use may be incorporated into the direct positive type silver halide photographic material of the present invention. Examples of stabilizers that can be incorporated include triazoles, azaindenes, quaternary benzothiazolium compounds, mercapto compounds, and water-soluble inorganic salts of, for example, cadmium, cobalt, nickel, manganese, gold, thallium or zinc. Examples of usable hardeners include aldehydes (e.g., formalin, glyoxal, mucochlomic acid), S-triazines, epoxy compounds, aziridines, and vinylsulfonic acid. Examples of usable coating aids include saponins, sodium polyalkylenesulfonates, polyethylene glycol lauryl or oleyl monoether, amyl-containing alkyltaurines, and fluorine compounds. Examples of usable sensitizers include polyalkylene oxides and derivatives thereof. A color coupler may be also incorporated. If desired and necessary, additives such as a brightening agent, an ultraviolet absorber, an antiseptic, a matting agent, and an antistatic agent may be further incorporated.

In incorporating desensitizing dyes respectively represented by formula (I) and formula (II) for use in the present invention into the silver halide emulsion of the present invention, these compounds may be directly dispersed into the emulsion, or may be added to the emulsion after being dissolved in a solvent. Examples of the solvent include water, methanol, ethanol, propanol, acetone, methyl cellosolve, 2,2,3,3-tetrafluoropropanol, 2,2,2-trifluoroethanol, 3-methoxy- 1-propanol, 3-methoxy-1-butanol, 1-methoxy-2-propanol, acetonitrile, tetrahydrofuran, and N,N-dimethylformamide; these solvents may be used alone or in admixture.

Also usable are a method comprising dissolving the dyes in a volatile organic solvent, dispersing the solution into water or a hydrophilic colloid, and adding this dispersion to the emulsion, as described in U.S. Pat. No. 3,469,987; a method comprising dispersing the water-insoluble dyes into a water-soluble solvent without dissolving the dyes, and adding this dispersion to the emulsion, as described in JP-B-46-24185 (the term "JP-B" as used herein means an "examined Japanese patent publication"); a method comprising dissolving the dyes in an acid or dissolving the dyes in water in the presence of an acid or a base, and adding the solution to the emulsion, as described in JP-B-44-23389, JP-B-44-27555, and JP-B-57-22091; a method comprising adding the dyes to water in the presence of a surfactant and adding the resulting solution or colloidal dispersion to the emulsion, as described in U.S. Pat. Nos. 3,822,135 and 4,006,025; a method comprising directly dispersing the dyes into a hydrophilic colloid and adding the dispersion to the emulsion, as described in JP-A-53-102733 and JP-A-58-105141; and a method comprising dissolving the dyes using a compound which causes red shifting, and adding the solution to the emulsion, as described in JP-A-51-74624.

Ultrasonic waves may be used for dissolution.

The addition of the desensitizing dyes represented by formula (I) and formula (II) for use in the present invention to the silver halide emulsion of the present invention may be carried out at any step in an emulsion preparation process before emulsion application, as long as such addition timing has been proved useful. For example, the dyes may be added during the step of silver halide grain formation or/and before the desalting step, as described in U.S. Pat. Nos. 2,735,766, 3,628,960, 4,183,756, and 4,225,666, JP-A-58-184142, and JP-A- 60-196749; or during the desalting step and/or during the duration from desalting to the initiation of chemical ripening; or immediately before or during the step of chemical ripening, as described in JP-A-58-113920; or during the duration from the completion of chemical ripening to emulsion application. Furthermore, as disclosed in U.S. Pat. No. 4,225,666 and JP-A-58- 7629, a single compound alone or a combination of compounds having different structures may be added, for example, during a single step or portion-wise during different steps (e.g., during the step of grain formation and during or after the step of chemical ripening; or before or during the step of chemical ripening and after the step). In the case of such portion-wise addition, the compound or the combination of compounds may be changed.

A predetermined dye amount may be added in a short time period, or may be continuously added over a prolonged time period in any desired step(s), e.g., over the duration from the completion of nucleation in the step of grain formation to the completion of grain formation or over most of the step of chemical ripening. The rate of addition in such continuous addition may be constant, increased, or reduced.

The addition amount of the desensitizing dyes represented by formula (I) and formula (II) is preferably from 50 mg to 20 g, more preferably from 100 mg to 10 g, per mol of silver.

The direct positive type silver halide for use in the present invention may contain either or both of an inorganic desensitizer (e.g., noble metal atoms contained in silver halide grains) and an organic desensitizer which is adsorbed onto silver halide surfaces.

For incorporating an inorganic desensitizer for use in the present invention into silver halide grains, use may be made of a method in which a water-soluble compound of a noble metal, e.g., a chloride of a Group 8 metal of the periodic table such as iridium, rhodium, or ruthenium, is added as an aqueous solution during the preparation of silver halide grains in an amount of from $10^{-7}$ to $10^{-2}$ mol, preferably from $10^{-5}$ to $10^{-3}$ mol, per mol of the silver halide.

The organic desensitizer for use in the present invention is a substance which can catch free electrons generated within the silver halide grains upon exposure to radiation and which is adsorbed onto the silver halide. This organic desensitizer is also defined as a substance having a minimum vacant electron energy level which is lower than the electron energy level in conduction band of the silver halide grains. The organic desensitizer is preferably a compound having a maximum occupied electron energy level which is lower than the valence band of the grains.

Such minimum vacant electron energy level can be evaluated by a reduction potential measurement. The reduction potential can be measured by a phase discrimination type second-harmonic AC polarography.

Organic desensitizers that can be used in combination with the direct positive type silver halide in the present invention are those having a reduction potential of −1.0 ($V_{VS}$ SCE) or higher. Compounds having a reduction potential lower than −1.0 ($V_{VS}$ SCE) do not function as a desensitizer. Most of such organic desensitizers having a reduction potential of −1.0 ($V_{VS}$ SCE) or higher are given in, e.g., U.S. Pat. Nos. 3,023,102, 3,314,796, 2,901,351, and 3,367,779, British Patents 723,019, 698,575, 698,576, 834,839, 667,206, 748,681, 796,873, 875,887, 905,237, 907,367 and 940,152, French Patents 1,502,819, 1,520,823, 1,520,821 and 1,523,626, Belgian Patents 722,457 and 722,594, JP-B-43-13167, JP-B-43-14500, and JP-A-2-34832.

Especially preferred desensitizers are those enumerated in JP-A-2-34832, from p. 11, right upper column to p. 12, right lower column, and from p. 18, left upper column to p. 23, left lower column.

The electrically conductive layer for use in the preferable embodiment of the present invention is then explained. The conductive layer is preferably provided between the silver halide emulsion layer containing the desensitizing dyes of this invention and a support and/or on that side of the support which is opposite to the silver halide emulsion layer.

The electrically conductive layer in the direct positive type silver halide photographic material of the present invention can be formed by a method using a water-soluble conductive polymer, hydrophobic polymer particles, a hardener or the like, or a method using a metal oxide.

Detailed explanations of the former method including the compounds are given in, e.g., JP-A-4-208937, from p. 6, right upper column, line 6 to p. 16, left upper column, line 3; and JP-A-62-215272, from p. 210, left lower column, line 1 to p. 230, left lower column, line 19. In the present invention, compounds and preparation methods described therein are preferably used.

The latter method using a metal oxide is more preferred in the present invention.

The preferred method, by which a conductive layer is formed from a metal oxide, is then explained.

The metal oxide is desirably particles of a crystalline metal oxide. A metal oxide having oxygen deficiency and a metal oxide containing a small amount of atoms of a different element which form a donor for the metal oxide are preferred because such metal oxides generally have high conductivity. The latter metal oxide, containing a small amount of atoms of a different element which can form a donor for the metal oxide, is especially preferred since this metal oxide does not fog the silver halide emulsion.

Desirable examples of the metal oxide include $ZnO_2$, $TiO_2$, $SnO_2$, $Al_2O_3$, $In_2O_3$, $SiO_2$, MgO, BaO, $MoO_3$, $V_2O_5$, and composite oxides thereof. Preferred of these are $ZnO_2$, $TiO_2$, and $SnO_2$.

In particular, $SnO_2$ is especially preferred.

The effective metal oxide containing atoms of a different element may be prepared, for example, by adding Sb or another element to $SnO_2$, or by adding Nb, Ta, or another element to $TiO_2$. The addition amount of atoms of such a different element is desirably from 0.01 to 30 mol %, preferably from 0.1 to 10 mol %.

The metal oxide particles for use in the present invention are electrically conductive and have a volume resistivity of desirably $10^7$ Ωcm or lower, preferably $10^5$ Ωcm or lower.

This oxide is described in, e.g., JP-A-56-143431, JP-A-56-120519, and JP-A-58-62647.

The metal oxide particles are dispersed or dissolved in a binder before being applied. Any binder having film-forming properties is usable without particular limitations. Examples of the binder include proteins (e.g., gelatins, casein), cellulose derivative (e.g., carboxymethyl cellulose, hydroxyethyl cellulose, acetyl cellulose, diacetyl cellulose, triacetyl cellulose), saccharides (e.g., dextran, agar, sodium alginate, starch derivatives), and synthetic polymers (e.g., polyvinyl alcohol, polyvinyl acetate, polyacrylates, polymethacrylates, polystyrene, polyacrylamide, poly-N-vinylpyrrolidone, polyesters, polyvinyl chloride, polyacrylic acid).

Especially preferred are gelatins (e.g., lime-treated gelatin, acid-treated gelatin, enzyme-decomposed gelatin, phthalated gelatin, acetylated gelatin), acetyl cellulose, diacetyl cellulose, triacetyl cellulose, polyvinyl alcohol, polyvinyl acetate, polybutyl acrylate, polyacrylamide, and dextran.

Although higher metal oxide volume contents in the conductive layer are desirable for more effectively utilize the metal oxide to lower the resistivity of the conductive layer, a binder should be used in an amount of at least about 5% in order to impart sufficient strength to the layer. Hence, the metal oxide content is preferably from 5 to 95% by volume.

The amount of the metal oxide used is desirably from 0.01 to 10 g/m$^2$, preferably from 0.05 to 5 g/m$^2$. Thus, antistatic properties are obtained.

In the present invention, the conductive layer is formed between the silver halide emulsion layer and a support and/or on that side of the support which is opposite to the emulsion layer. Namely, the conductive layer may be formed on a transparent support either on the side on which the photosensitive emulsion layer is formed, or on the side opposite to the photosensitive emulsion layer, i.e., on the so-called back side (reverse side).

The conductive layer is formed by coating on a transparent support.

All transparent supports for photographic use can be used in the present invention. It is however preferred to use a polyethylene terephthalate or cellulose triacetate support having a visible light transmittance of 90% or higher.

These transparent supports can be produced by methods well known to artisans. In some cases, a bluish support produced by incorporating a dye in such a slight amount as not to impair light transmission may be used.

The support is subjected to corona discharge processing, following which an undercoat layer containing a latex polymer may be formed by coating. The corona discharge processing is especially preferably performed at 1 mW/m$^2$·min to 1 kW/m$^2$·min in terms of energy value. It is particularly preferred to perform corona discharge processing again after the latex undercoating prior to the formation of the conductive layer by coating.

In the photographic material of the present invention, colloidal silver and dyes are used for preventing irradiation, antihalation, for separation of spectral sensitivity distribution in each of the light-sensitive layers, and for ensuring safety to a safelight.

The direct positive type silver halide photographic material preferably contains at least one water-soluble dye.

The water-soluble dye used in the present invention is a dye having a solubility in 25° C. water of 0.5% or higher, preferably 1% or higher.

The desirable dyes are enumerated in JP-A-5-188516, from p. 13 column 24, line 5 from the bottom, paragraph [0024] to p. 42 paragraph [0108], which dyes are represented by formula (II) {(IIa), (IIb), (IIc), (IId), or (IIe)}, (III), (IV), (V), (VI), or (VII) described therein.

Preferred dyes of these are the water-soluble dyes represented by the following formulae (IIa) and (III):

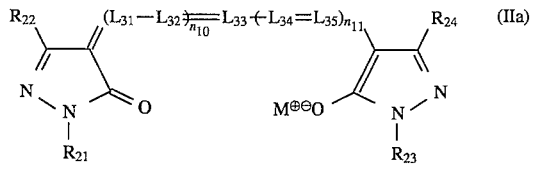

(IIa)

In formula (IIa), $R_{21}$ and $R_{23}$ are the same or different and each represents an aliphatic group, an aromatic group, or a heterocyclic group.

$R_{22}$ and $R_{24}$ are the same or different and each represents an alkyl group, an aryl group, $—OR_{25}$, $—CO_2R_{25}$, $—NR_{25}R_{26}$, $—CONR_{25}R_{26}$, $—NR_{25a}CONR_{25}R_{26}$, $—SO_2R_{26}$, $—COR_{26}$, $—NR_{25}COR_{26}$, $—NR_{26}SO_2R_{27}$, or a cyano group, wherein $R_{25}$, $R_{25a}$, and $R_{26}$ each represents a hydrogen atom, an alkyl group, or an aryl group; and $R_{27}$ represents an alkyl group or an aryl group, provided that either $R_{25}$ and $R_{26}$ or $R_{26}$ and $R_{27}$ may be bonded to each other to form a 5- or 6-membered ring.

$L_{31}$, $L_{32}$, $L_{33}$, $L_{34}$ and $L_{35}$ each represents a methine group.

$n_{10}$ and $n_{11}$ each represents 0 or 1.

$M^+$represents a hydrogen ion or a monovalent cation.

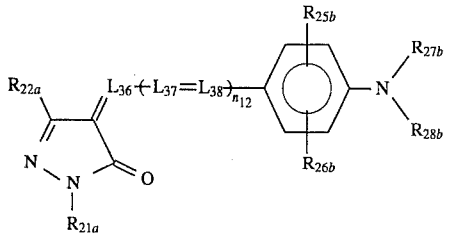

(III)

In formula (III), $R_{25b}$ and $R_{26b}$ are the same or different and each represents a hydrogen atom, a halogen atom, an alkyl group, an alkoxy group, a hydroxyl group, a carboxyl group, a substituted amino group, a carbamoyl group, a sulfamoyl group, an alkoxycarbamoyl group, or a sulfo group.

$R_{27b}$ and $R_{28b}$ are the same or different and each represents a hydrogen atom, an alkyl group, an alkenyl group, an aryl group, an acyl group, or a sulfonyl group. $R_{27b}$ and $R_{28b}$ may be bonded to each other to form a 5- or 6-membered ring. Either $R_{25b}$ and $R_{27b}$ or $R_{26b}$ and $R_{28b}$ may be bonded to each other to form a 5- or 6-membered ring.

$R_{21a}$ has the same meaning as $R_{21}$, and $R_{22a}$ has the same meaning as $R_{22}$.

At least one of $R_{21a}$, $R_{22a}$, $R_{25b}$, $R_{26b}$, $R_{27b}$, and $R_{28b}$ has a sulfo group or a carboxyl group as a substituent.

$L_{36}$, $L_{37}$, and $L_{38}$ are the same or different and each represents a substituted or unsubstituted methine group, and $n_{12}$ represents 0 or 1.

Formula (II-a) is then explained in detail.

The aliphatic group or the alkyl group represented by each of $R_{21}$, $R_{22}$, $R_{23}$, $R_{24}$, $R_{25}$, $R_{25a}$, $R_{26}$ and $R_{27}$ may be any of an alkyl group, an aralkyl group, and an alkenyl group, which each may be linear, branched, or cyclic. Examples thereof include methyl, ethyl, n-butyl, benzyl, 2-sulfoethyl, 4-sulfobutyl, 2-sulfobenzyl, 2-carboxyethyl, carboxymethyl, trifluoromethyl, dimethylaminoethyl, and 2-hydroxyethyl.

Examples of the aromatic group or the aryl group represented by each of $R_{21}$, $R_{22}$, $R_{23}$, $R_{24}$, $R_{25}$, $R_{25a}$, $R_{26}$ and $R_{27}$ include phenyl, naphthyl, 4-sulfophenyl, 3-sulfopentyl, 2,5-disulfophenyl, 4-carboxyphenyl, and 5,7-disulfo-3-naphthyl.

The heterocyclic group represented by $R_{21}$ or $R_{23}$ is a 5- or 6-membered nitrogenous heterocyclic group (including a fused ring). Examples thereof include 5-sulfopyridin-2-yl and 5-sulfobenzothiazol-2-yl.

Examples of the 5- or 6-membered ring formed by the bonding of either $R_{25}$ and $R_{26}$ or $R_{26}$ and $R_{27}$ include a pyrrolidine ring, a piperidine ring, a pyrrolidone ring, and a morpholine ring.

Specific examples of the dye represented by formula (IIa) are given below, but the present invention should not be construed as being limited thereto.

| No. | $R_{21}$, $R_{23}$ | $R_{22}$, $R_{24}$ | $\neq L_{31}-L_{32}\neq_{n10}=L_{33}\neq L_{34}=L_{35}\neq_{n11}$ | $M^{\oplus}$ |
|---|---|---|---|---|
| a-1 | 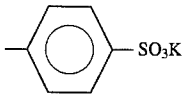 | $-CH_3$ | $=CH-$ | H |
| a-2 | 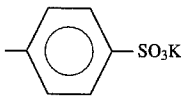 | $-CONHC_3H_7^{(n)}$ | $=CH-$ | H |
| a-3 | 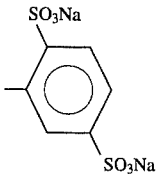 | $-OH$ | $=CH-CH=CH-$ | Na |
| a-4 | 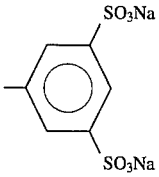 | $-OC_2H_5$ | $=CH\neq CH=CH\neq_2$ | Na |
| a-5 | $-CH_2CH_2SO_3K$ | $-COOC_2H_5$ | $=CH-CH=CH-$ | H |
| a-6 | 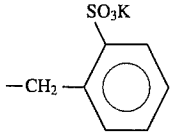 | $-CONHC_4H_9^{(n)}$ | $=CH-CH=CH-$ | H |
| a-7 | $-CH_2CH_2SO_3K$ | $-COOK$ | $=CH\neq CH=CH\neq_2$ | H |

-continued

| No. | $R_{21}$, $R_{23}$ | $R_{22}$, $R_{24}$ | $\overline{\!(L_{31}-L_{32})_{n10}\!}L_{33}\!(L_{34}=L_{35})_{n11}\!$ | $M^{\oplus}$ |
|---|---|---|---|---|
| a-8 | 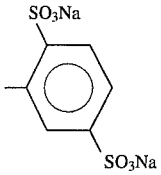 | $-COCH_3$ | $=CH\!(CH=CH)_2$ | Na |
| a-9 | 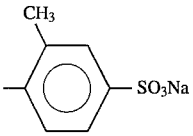 | $-CF_3$ | $=CH\!(CH=CH)_2$ | H |
| a-10 | 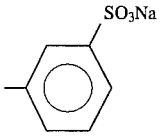 | $-NHCOCH_3$ | $=CH-CH=CH-$ | H |
| a-11 | 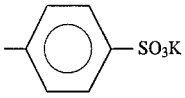 | $-COOC_2H_5$ | $=CH\!(CH=CH)_2$ | H |
| a-12 | 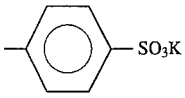 | $-COOC_2H_5$ | $=CH-CH=CH-$ | H |
| a-13 | 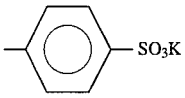 | $-NHCONHCH_3$ | $=CH-CH=CH-$ | H |
| a-14 | $-(CH_2)_4SO_3K$ | $-OH$ | $=CH-$ | H |
| a-15 | 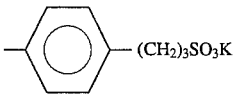 | $-COOC_2H_5$ | $=CH-CH=CH-$ | K |
| a-16 | 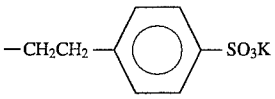 | $-C_6H_5$ | $=CH-CH=CH-$ | H |
| a-17 | 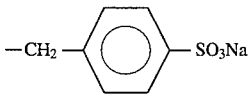 | $-COOC_2H_5$ | $=CH\!(CH=CH)_2$ | Na |
| a-18 | 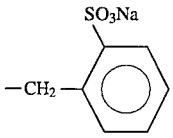 | $-CONHCH_2CH_2OH$ | $=CH\!(CH=CH)_2$ | H |
| a-19 | 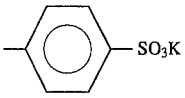 | $-CONHCH_2CH_2SO_3K$ | $=CH\!(CH=CH)_2$ | H |
| a-20 | $-(CH_2)_3SO_3K$ | $-CONHC_7H_{15}{}^{(n)}$ | $=CH-CH=CH-$ | H |
| a-21 | $-CH_2COOK$ | $-COOK$ | $=CH-CH=CH-$ | K |
| a-22 | $-CH_2CH_2SO_3K$ | $-N(CH_3)_2$ | $=CH\!(CH=CH)_2$ | H |
| a-23 | $-(CH_2)_3SO_3K$ | $-CN$ | $=CH\!(CH=CH)_2$ | H |

-continued

| No. | $R_{21}$, $R_{23}$ | $R_{22}$, $R_{24}$ | $\neq L_{31}-L_{32}\neq_{n10}L_{33}\neq L_{34}=L_{35}\neq_{n11}$ | $M^{\oplus}$ |
|---|---|---|---|---|
| a-24 | 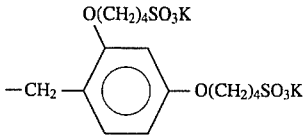 | $-CH_2Cl$ | $=CH\neq CH=CH\neq_2$ | H |
| a-25 | $-(CH_2)_2SO_3Na$ | $-OH$ | $=CH\neq CH=CH\neq_2$ | H |
| a-26 | 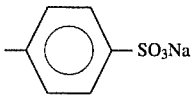 | $-CH_3$ | $=CH-\overset{CH_3}{\overset{\vert}{C}}=CH-$ | Na |
| a-35 | 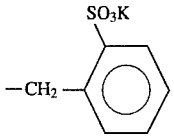 | $-COOK$ | $=CH\neq CH=CH\neq_2$ | H |
| a-36 | 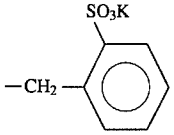 | $-COOK$ | $=CH-CH=CH-$ | H |
| a-37 | 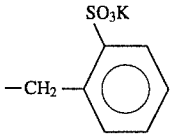 | $-CONHC_4H_9^{(i)}$ | $=CH\neq CH=CH\neq_2$ | H |
| a-38 | 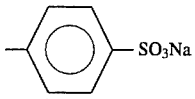 | $-NHSO_2CH_3$ | $=CH\neq CH=CH\neq_2$ | H |
| a-39 | 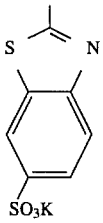 | $-CN$ | $=CH\neq CH=CH\neq_2$ | H |
| a-40 | 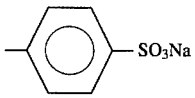 | $-OC_2H_5$ | $=CH\neq CH=CH\neq_2$ | H |
| a-41 | 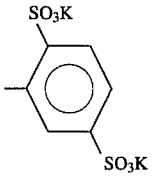 | $-CN$ | $=CH\neq CH=CH\neq_2$ | H |
| a-42 | 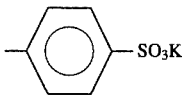 | $CO_2H$ | $=CH\neq CH=CH\neq_2$ | H |

These dyes can be synthesized by the methods described in British Patent Nos. 506,385, 1,177,429, 1,338,799, 1,385,371, 1,467,214, 1,433,102 and 1,553,516, JP-A-48-85130, JP-A-55-161233, JP-A-52-20330, JP-A-59-111640, and JP-A-62- 273527.

Formula (III) is then explained. $R_{25b}$ and $R_{26b}$ are the same or different and each represents a hydrogen atom, a halogen atom (e.g., chlorine, bromine), an alkyl group (an alkyl group which may be substituted and preferably has from 1 to 5 carbon atoms, e.g., methyl, ethyl), an alkoxy group (an alkoxy group which may be substituted and preferably has from 1 to 5 carbon atoms, e.g., methoxy, ethoxy, 2-chloroethoxy), a hydroxyl group, a carboxyl group, a substituted amino group (e.g., acetylamino, methylamino, diethylamino, methanesulfonylamino), a carbamoyl group (a carbamoyl group which may be substituted, e.g., methylcarbamoyl), a sulfamoyl group (a sulfamoyl group which may be substituted, e.g., ethylsulfamoyl), an alkoxycarbonyl group (e.g., methoxycarbonyl), or a sulfo group.

$R_{27b}$ and $R_{28b}$ are the same or different and each represents a hydrogen atom, an alkyl group (an alkyl group which may be substituted and preferably has from 1 to 8 carbon atoms, e.g., a methyl group, an ethyl group, a propyl group, a butyl group; examples of substituents include a sulfo group, a carboxyl group, a halogen atom, a hydroxyl group, a cyano group, an alkoxy group, an alkylcarbonyl group, an arylcarbonyl group, an acyloxy group, an acylamino group, a carbamoyl group, a sulfamoyl group, an alkylamino group, a dialkylamino group, an alkoxycarbonyl group, an aryloxycarbonyl group, an alkylsulfonyl group, an arylsulfonyl group, a sulfonylamino group, a ureido group, and an aryl group), an alkenyl group (an alkenyl group which may be substituted, e.g., 3-hexenyl), an aryl group (which may be substituted, e.g., phenyl), an acyl group (e.g., acetyl, benzoyl), or a sulfonyl group (e.g., methanesulfonyl, phenylsulfonyl).

$R_{27b}$ and $R_{28b}$ may be bonded to each other to form a 5- or 6-membered heterocycle (e.g., a piperidine ring, a morpholine ring).

Either $R_{25b}$ and $R_{27b}$ or $R_{26b}$ and $R_{28b}$ may be bonded to each other to form a 5- or 6-membered heterocyclic ring. Preferable examples of $R_{21a}$ and $R_{22a}$ are the same as those of $R_{21}$ and $R_{22}$, respectively.

At least one of $R_{21a}$, $R_{22a}$, $R_{25b}$, $R_{26b}$, $R_{27b}$, and $R_{28b}$ has a sulfo group or a carboxyl group as a substituent. This sulfo or carboxyl group may be in a free form or a salt form (e.g., Na salt, K salt, $(C_2H_5)_3NH$ salt, pyridinium salt, ammonium salt).

The methine group represented by $L_{36}$, $L_{37}$ or $L_{38}$ may have a substituent (e.g., methyl, ethyl, cyano, phenyl, chlorine atom, sulfoethyl).

Further, $n_{12}$ represents 0 or 1.

Specific examples of the dye represented by formula (III) for use in the present invention are shown below.

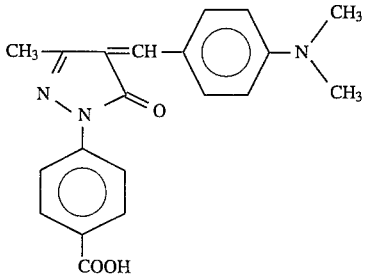

(III-1)

-continued

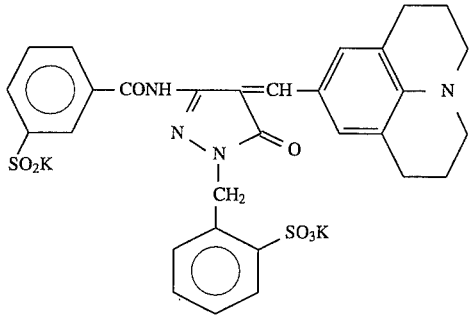

(III-2)

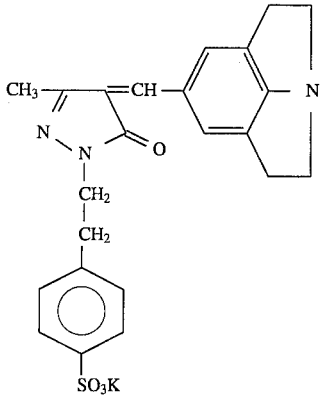

(III-3)

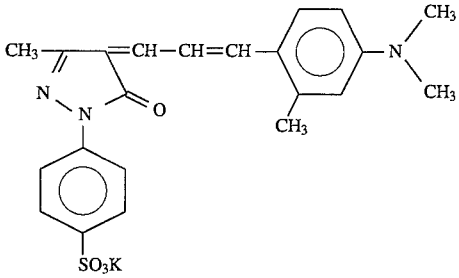

(III-4)

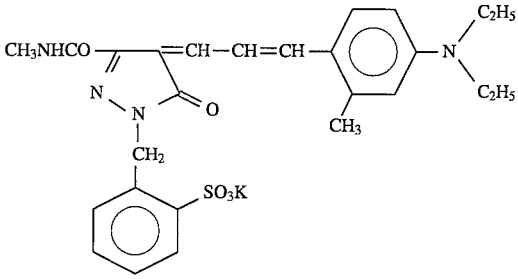

(III-5)

-continued

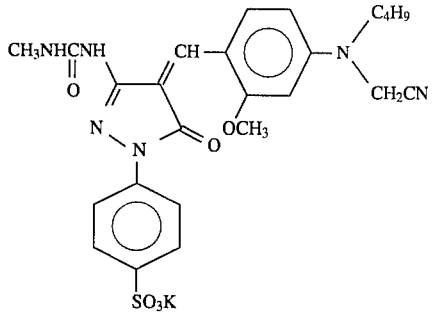

(III-6)

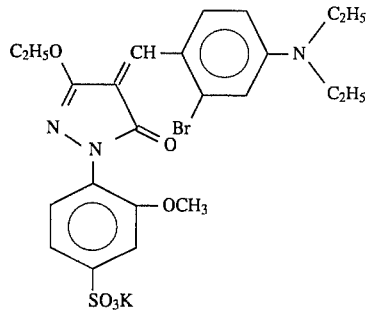

(III-7)

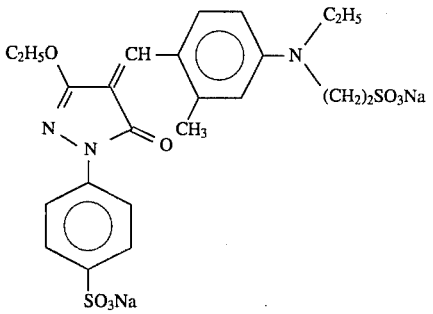

(III-8)

These dyes represented by formula (III) can be easily synthesized by the method described in, e.g., JP-A-51-3623.

For preventing the diffusion of these dyes, the following methods may be used. For example, a ballast group is incorporated into a dye to render the dye diffusion-resistant.

Another method is to incorporate as a mordant a hydrophilic polymer having an opposite charge to that of a dissociated anionic dye into a layer containing the dye to thereby keep the dye within the layer by means of interaction between molecules of the polymer and dye molecules. This method is disclosed in, e.g., U.S. Pat. Nos. 2,548,564, 4,124,386, and 3,625,694.

Still another method is to dye a desired layer with a water-insoluble solid dye. This method is disclosed in, e.g., JP-A-56-12639, JP-A-55-155350, JP-A-55-155351, JP-A-63-27838, JP-A-63-197943, and European Patent 15,601.

A further method is to dye a desired layer with fine metal salt particles to which a dye has been adsorbed. This method is disclosed in, e.g., U.S. Pat. Nos. 2,719,088, 2,496,841, and 2,496,843, and JP-A-60-45237.

The water-soluble or water-insoluble dyes used in the present invention may be dispersed into an emulsion layer or another hydrophilic colloid layer (e.g., an interlayer, a protective layer, an antihalation layer, a filter layer) by various known methods.

(i) A method in which a dye of the present invention is dissolved or dispersed into an emulsion layer or a hydrophilic colloid layer either directly or after being dissolved or dispersed into an aqueous medium or a solvent:

The dye may be added as a solution to the emulsion after being dissolved into an appropriate solvent, e.g., methyl alcohol, ethyl alcohol, propyl alcohol, methyl cellosolve, the halogenated alcohol described in JP-A-48-9715 or U.S. Pat. No. 3,756,830, acetone, water, pyridine, or a mixture thereof.

(ii) A method in which a hydrophilic polymer having an opposite charge to that of dye ions is incorporated as a mordant into a layer containing the dye to thereby keep the dye within the layer by means of interaction between molecules of the polymer and dye molecules:

Examples of the polymeric mordant include polymers having secondary and tertiary amino groups, polymers having a nitrogenous heterocyclic part, and polymers of these kinds which have a quaternary cation group. These polymers have a molecular weight of desirably 5,000 or higher, preferably 10,000 or higher.

Specific examples of the polymeric mordant include the vinylpyridine polymer and vinylpyridinium cation polymer described in U.S. Pat. No. 2,548,564; the vinylimidazolium cation polymer disclosed in U.S. Pat. No. 4,124,386; the polymeric mordant capable of being crosslinked to, e.g., gelatin which is disclosed in U.S. Pat. No. 3,625,694; the hydrosol type mordant disclosed in U.S. Pat. No. 3,958,995 or JP-A-54-115228; the water-insoluble mordant disclosed in U.S. Pat. No. 3,898,088; the reactive mordant capable of coordinating with a dye which is disclosed in U.S. Pat. No. 4,168,976; polymers derived from an ethylenically unsaturated compound and having a dialkylaminoalkyl ester residue, such as the polymer described in British Patent 685,475; products of the reaction of a polyvinyl alkyl ketone and aminoguanidine, such as the polymer described in British Patent 850,281; and polymers derived from 2-methyl-1-vinylimidazole, such as the polymer described in U.S. Pat. No. 3,445,231.

(iii) A method in which a compound is dissolved using a surfactant:

Useful surfactants may be oligomers or polymers.

These polymers are described in detail in JP-A-60-158437, pp. 19–27.

The hydrosol of a lipophilic polymer described in JP-B-51-39835 may be incorporated into the hydrophilic colloidal dispersion obtained above.

(iv) Dispersion of fine solid particles (method for preparing a dye precipitate in the form of a dispersion of fine solid particles):

Examples of this method include a technique in which a solid dye is treated with a known pulverizing means such as ball milling (using, e.g., a ball mill, a vibrating ball mill, a planetary ball mill), sand milling, colloid milling, jet milling, roller milling, or the like in the presence of a dispersant to form a dispersion of fine solid particles [the pulverization may be conducted in the presence of a solvent (e.g., water, alcohol)]; a technique in which a dye is dissolved in an appropriate solvent and a poor solvent for the dye is added to the solution to precipitate the dye as fine crystals (a surfactant as a dispersing agent may be used); and a technique in which a dye is first dissolved by controlling pH and the pH of the solution is then changed to precipitate the dye as fine crystals. The fine crystal particles of the water soluble dye used in the present invention in the dispersion have an average particle diameter of 10 μm or smaller, preferably 2 μm or smaller, and more preferably 0.5 μm or smaller. In some cases, fine particles of 0.1 μm or smaller are especially preferred.

Examples of the developing agent for use in developing the silver halide photographic material according to the present invention include the organic or inorganic developers and developing aids enumerated in E. K. Meath and T. H. James, *The Theory Of The Photographic Process,* 3rd. Ed., pp. 278–381 (1966). These developers and developing aids may be used alone or in combination of two or more thereof. Desirable examples thereof include ferrous oxalate, hydroxylamine, N-hydroxymorpholine, hydroquinone and derivatives thereof such as hydroquinonemonosulfonate, chlorohydroquinone, and t-butylhydroquinone, catechol, resorcin, pyrogallol, amidol, pyrazolidone derivatives such as phenidone and 4-hydroxymethyl- 4-methyl-1-phenyl-3-pyrazolidone, p-aminophenol, glycine, p-aminophenol derivatives such as Metol (p-methylaminophenol), p-phenylenediamine and derivatives thereof such as 4-amino-N-ethyl-N-ethoxyaniline, and ascorbic acid. Preferred are Metol alone, a combination of phenidone and Metol, a combination of Metol and hydroquinone, a combination of phenidone, Metol, and t-butylhydroquinone, a combination of phenidone and ascorbic acid, a combination of phenidone and p-aminophenol, and the like. Besides these combinations, other various combinations may be used to obtain almost the same satisfactory results.

The amount of most of the above-enumerated developing agents incorporated into the developing solution for use in the present invention for developing the silver halide photographic material may be from $1\times10^{-5}$ mol to 1 mol per liter of the developing solution. With respect to hydroquinone, the amount thereof is desirably 20 g/l or more, preferably 25 g/l or more. Besides the developing agents, various additives may be incorporated without particular limitations into the developing solution for use in the present invention for developing the silver halide photographic material. Examples of such additives include preservatives (e.g., sulfurous acid salts and hydroxylamines); agents serving as both a pH regulator and a buffer, such as those for ordinary developing solutions for black-and-white photographic materials (e.g., caustic alkalis, alkali carbonates, alkali borates, amines); inorganic development inhibitors (e.g., potassium bromide); and organic development inhibitors (e.g., benzoimidazole, benzotriazole, the nitroindazole shown in British Patent No. 1,376,660).

The photographic material of the present invention may be exposed by any method, but exposure with a laser is preferred. An especially preferred laser is an He-Ne laser.

The direct positive type silver halide photographic material of the present invention is used in various applications. For example, it can be used as a photographic material for various printing uses (e.g., duplication, reproduction, offset master production), as a photographic material for special photographic uses (e.g., X-ray photography, flash photography, electron-ray photography), or as a photographic material for various direct-positive photographic uses (e.g., general copying, microcopying, laser gum recording, direct-positive color photography, quick stabilized photography, diffusion transfer, color diffusion transfer, monobath processing). These direct positive type silver halide photographic materials have higher contrast than conventional ones and have extremely high stability during long-term storage and under high-temperature and high-humidity conditions.

The present invention will be explained below in more detail by reference to the following Examples, which should not however be construed as limiting the embodiments of the present invention.

EXAMPLES

Example 1

A 100 μm-thick polyethylene terephthalate support undercoated on both sides was successively coated on one side with a conductive layer and a protective layer in this order, which layers respectively had the following compositions.

| | |
|---|---|
| (1) Conductive Layer | |
| Jurymer ET-410 (polyacrylic ester); manufactured by Nippon Junyaku Co., Ltd., Japan) | 38 mg/m$^2$ |
| $SnO_2$/Sb (9/1 by weight; average particle diameter, 0.25 μm) | 216 mg/m$^2$ |
| Compound 1 | 5 mg/m$^2$ |
| Compound 2 | 5 mg/m$^2$ |
| (2) Protective Layer | |
| Chemipearl S-120 (aqueous polyolefin dispersion; manufactured by Mitsui Petrochemical Industries, Ltd., Japan) | 33 mg/m$^2$ |
| Snowtex C (Nissan Chemical Industries, Ltd. Japan) | 17 mg/m$^2$ |
| Compound 1 | 5 mg/m$^2$ |
| Compound 3 | 5 mg/m$^2$ |
| Sodium polystyrenesulfonate | 2 mg/m$^2$ |
| Hardener (compound H-1) | 50 mg/m$^2$ |

Compound 1

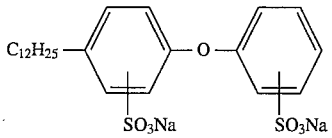

Compound 2

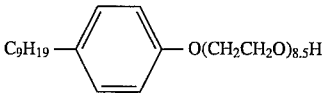

Compound-3

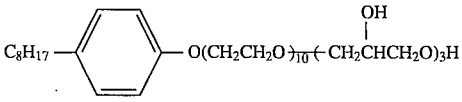

H-1

$CH_2{=}CHSO_2CH_2SO_2CH{=}CH_2$

The support was then coated on the opposite side with a dye layer, an emulsion layer, and a protective layer by simultaneous coating, which layers respectively had the following compositions.

| (3) Dye Layer | |
|---|---|
| Gelatin | 2400 mg/m$^2$ |
| Proxel | 8 mg/m$^2$ |
| Dye 1 | 45 mg/m$^2$ |
| Dye 2 | 90 mg/m$^2$ |
| Surfactant 1 | 68 mg/m$^2$ |
| Sodium p-dodecylbenzenesulfonate | 20 mg/m$^2$ |
| 1,3-Vinylsulfonyl-2-propanol | 285 mg/m$^2$ |
| Strontium barium sulfate | 300 mg/m$^2$ |
| Liquid paraffin | 310 mg/m$^2$ |

(4) Emulsion Layer

Preparation of Emulsion:

Citric acid was added to an aqueous gelatin solution kept at 50° C., and $AgNO_3$ and KBr solution were added thereto by the controlled double jet method over a period of 30 minutes in the presence of a thioether ($HOCH_2CH_2SCH_2CH_2SCH_2CH_2OH$). Thus, a monodisperse cubic silver bromide emulsion having a grain size of 0.1 μm was prepared.

This emulsion was desalted by the flocculation method. Gelatin was then added thereto, and the mixture was maintained at 65° C. and pH 6.0. Thereto was added formamidinesulfinic acid in an amount of 0.08 mmol per mol of the silver, followed by 0.024 mmol of tetrachloroauric acid. This mixture was ripened for 60 minutes. Subsequently, KBr and phosphoric acid were added thereto to adjust the pAg and pH to 9.0 and 4.4, respectively, and the resulting mixture was ripened for 30 minutes while bleaching the silver nuclei. Thereafter, $AgNO_3$ and NaOH were added thereto to adjust the pAg and pH to 7.2 and 6.2, respectively, and this emulsion was then stored.

To this emulsion were added at 40° C. the desensitizing dyes shown in Table 1 in the respective amounts shown in Table 1. Sodium polystyrenesulfonate was then added as a thickening agent in an amount of 20 mg per g of gelatin, and the pH of this mixture was adjusted to 5.2 with phosphoric acid. A polyethyl acrylate latex (average particle diameter, 0.05 μm) was further added as a plasticizer in an amount of 30% by weight based on the amount of the gelatin. Thereto was added hardener H-1. This coating liquid was applied in such an amount as to result in an Ag amount of 1.3 g/m$^2$, a gelatin amount of 1.25 g/m$^2$, and a hardener amount of 250 mg/m$^2$.

| (5) Protective Layer | |
|---|---|
| Gelatin | 0.5 g/m$^2$ |
| Benzoisothiazolone-3 | 2 mg/m$^2$ |
| Fine polymethyl methacrylate particles (average particle diameter, 0.9 μm) | 25 mg/m$^2$ |
| Compound 4 (dispersion in gelatin) | 37 mg/m$^2$ |
| Sodium dodecylbenzenesulfonate | 5 mg/m$^2$ |
| Compound 5 | 8 mg/m$^2$ |
| Collidal silica (Snowtex C; manufactured by Nissan Chemical Industries, Ltd.) | 88 mg/m$^2$ |
| N-Perfluorooctanesulfonyl-N-propylglycine potassium salt | 3 mg/m$^2$ |
| 1,5-Dihydroxy-2-benzaldoxime | 5 mg/m$^2$ |
| L-Ascorbic acid | 2 mg/m$^2$ |
| Sodium polystyrenesulfonate | 15 mg/m$^2$ |
| KBr | 74 mg/m$^2$ |

Compound 4

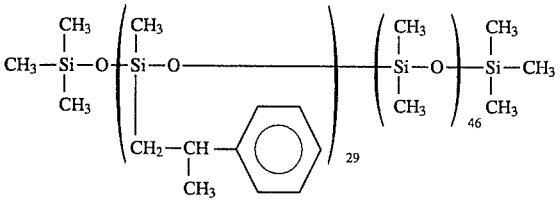

Compound 5

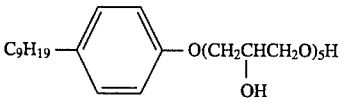

Surfactant 1

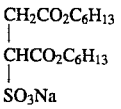

Dye 1

-continued (5) Protective Layer

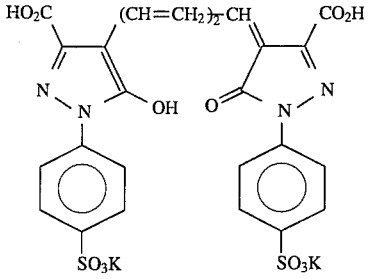

Dye 2

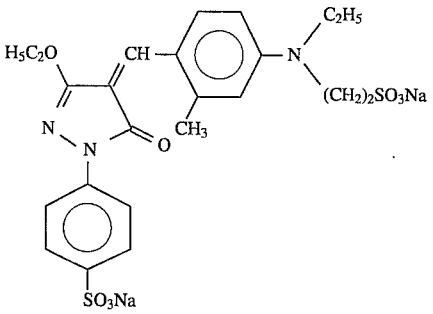

The samples thus obtained were stored for 12 hours at a temperature of 40° C. and a humidity of 55% RH and then evaluated for the following photographic properties.

(1) Sensitivity

Using a high-intensity xenon sensitometer (manufactured by Fuji Photo Film Co., Ltd.) and a 633-nm interference filter (transmission density at 633 nm, 0.76; half band width, 15.0 nm; manufactured by Fuji Photo Film Co., Ltd.), $10^{-3}$-second sensitometric exposure was conducted through a step wedge having a density gradation of 0.1. Scanning exposure was also conducted with a He-Ne laser. Subsequently, the exposed samples were processed at 38° C. for 20 seconds with developing solution (A) and fixing solution (B), both specified below, by means of automatic processor FG660F manufactured by Fuji Photo Film Co., Ltd. The sensitivity of each sample is shown in terms of toe sensitivity $S_{0.2}$ (relative value of the inverse of the exposure giving a density of (fog density+0.2)). Since exposure with the high-intensity xenon sensitometer and exposure with the He-Ne laser gave the same results, the results of the former exposure only are given in Table 1.

TABLE 1

| Sample No. | Desensitizing dye, Amount (mg/m²) | | Toe sensitivity ($S_{0.2}$) | Maximum density ($D_{max}$) | Minimum density ($D_{min}$) | Residual coloring | Remarks |
|---|---|---|---|---|---|---|---|
| 1 | I-1 (4.5) | | 100 (reference) | 2.20 | 0.10 | blue | comparison |
| 2 | I-1 (10.4) | | 98 | 2.19 | 0.10 | blue | " |
| 3 | II-3 (5.9) | | 117 | 2.22 | 0.08 | none | " |
| 4 | II-3 (10.4) | | 115 | 2.22 | 0.08 | " | " |
| 5 | II-17 (5.9) | | 115 | 2.20 | 0.08 | " | " |
| 6 | I-1 (4.5) | II-3 (5.9) | 275 | 2.30 | 0.06 | " | invention |
| 7 | I-1 (4.5) | II-17 (5.9) | 269 | 2.30 | 0.06 | " | " |
| 8 | I-35 (4.5) | | 102 | 2.19 | 0.10 | blue | comparison |
| 9 | I-35 (4.5) | II-3 (5.9) | 282 | 2.30 | 0.06 | none | invention |
| 10 | I-35 (4.5) | II-17 (5.9) | 275 | 2.31 | 0.06 | " | " |

For toe sensitivity, Sample No. 1 was used as a reference.
Residual coloring was examined in the $D_{min}$ part after processing.

| Developing Solution (A) | |
|---|---|
| Sodium 1,2-dihydroxybenzene-3,5-disulfonate | 0.5 g |
| Diethylenetriaminepentaacetic acid | 2.0 g |
| Sodium carbonate | 5.0 g |
| Boric acid | 10.0 g |
| Potassium sulfite | 85.0 g |
| Sodium bromide | 6.0 g |
| Diethylene glycol | 40.0 g |
| 5-Methylbenzotriazole | 0.2 g |
| Hydroquinone | 30.0 g |
| 4-Hydroxymethyl-4-methyl-1-phenyl-3-pyrazolidone | 1.6 g |
| 2,3,5,6,7,8-Hexahydro-2-thioxo-4-(1H)-quinazolinone | 0.09 g |
| Sodium 2-mercaptobenzoimidazole-5-sulfonate | 0.3 g |

Potassium hydroxide and water were added to adjust the total volume to 1 liter and the pH to 10.7.

| Formulation for Fixing Solution (B) | |
|---|---|
| Sodium thiosulfate | 1.1 mol/l |
| Ammonium thiosulfate | 0.2 mol/l |
| Sodium sulfite | 0.1 mol/l |
| Sodium metabisulfate | 0.08 mol/l |
| Disodium ethylenediaminetetraacetate dihydrate | 0.1 g/l |

Sodium hydroxide and water were added to adjust the pH 6.0 and the total volume to 1 liter.

As apparent from the results shown in Table 1, Sample Nos. 6, 7, 9, and 10 each containing a combination of desensitizing dyes of the present invention were higher in sensitivity and $D_{max}$ and lower in $D_{min}$ than Sample Nos. 1, 2, 3, 4, 5, and 8 which each contained a single desensitizing dye. Furthermore, Sample Nos. 6, 7, 9, and 10 were free from the residual blue coloring caused when desensitizing dye I-1 or I-35 was used alone.

As demonstrated above, exceedingly high performances can be obtained by using a combination of the desensitizing dyes of the present invention.

Example 1 shows that the direct positive type silver halide photographic materials employing combination of the desensitizing dyes of the present invention have high reversal sensitivity and are free from residual coloring.

Example 2

Samples were obtained in the same manner as in Example 1, except that the dye layer was changed to the following one and the desensitizing dyes shown in Table 2 were added to the emulsion in a total amount of 10 mg/m².

| (3) Dye Layer | |
|---|---|
| Gelatin | 1.0 g/m² |
| Solid disperse dye 1 | 0.120 g/m² |
| Phosphoric acid | 0.015 g/m² |
| Sodium dodecylbenzenesulfonate | 0.015 g/m² |
| Sodium polystyrenesulfonate | 0.025 g/m² |
| Hydroquinone | 0.050 g/m² |

Solid disperse dye 1

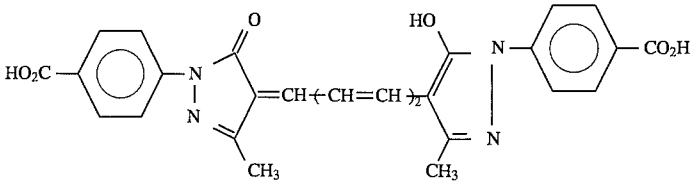

Preparation of the Solid Disperse Dye:

The dye was prepared in this invention in accordance with the method described in JP-A-63-197943.

That is, 434 ml of water and a 6.7% solution of 53 g of surfactant Triton X-200R (TX-200R) (available from Rohm & Hass) were placed in a 1.5-liter bottle with a screw cover. Thereto were added 20 g of the dye and 800 ml of zirconium oxide beads (diameter, 2 mm). This bottle was tightly covered, and placed in a mill to pulverize the dye for 4 days.

The contents were added to 160 g of 12.5% aqueous gelatin solution. This mixture was place on a roll mill for 10 minutes to reduce foams, and then filtered to remove the $ZrO_2$ beads. Since this mixture had an average grain diameter as small as about 0.3 μm, it was classified by centrifugal separation to obtain a dispersion having a grain size of 1 μm or smaller.

The samples thus obtained were stored for 12 hours at a temperature of 40° C. and a humidity of 55% RH, and then evaluated for the following photographic properties, after being vigorously rubbed with a neoprene rubber roller in a room under conditions of 25° C. and a low humidity (25% RH) in which room air purification was not especially conducted.

(1) Sensitivity

The rubbed samples were immediately thereafter subjected to $10^{-3}$-second sensitometric exposure using a high-intensity xenon sensitometer (manufactured by Fuji Photo Film Co., Ltd.) and a step wedge having a density gradation of 0.1. Subsequently, the exposed samples were processed at 38° C. for 20 seconds with the same developing solution (A) and fixing solution (B) as in Example 1, by means of automatic processor FG660F manufactured by Fuji Photo Film Co., Ltd.

The sensitivity of each sample is shown in terms of toe sensitivity $S_{0.2}$ (relative value of the inverse of the exposure giving a density of (fog+0.2)).

(2) Surface Resistivity

Each sample was allowed to stand at 25° C. and 25% RH for 12 hours, and then sandwiched between 10 cm-long brass electrodes (whose parts in contact with the sample were made of stainless steel) at an electrode distance of 0.14 cm to measure the surface resistivity thereof after 1 minute from the sample setting with electrometer $TR_{8651}$ manufactured by Takeda Riken K.K., Japan.

As is apparent from the results shown in Table 2, when Samples Nos. 101 and 102, which each contained a desensitizing dye, were compared, Sample No. 102 having a conductive layer had a lower surface resistivity and suffered slightly less pinhole generation than Sample No. 101 having no conductive layer. However, Sample No. 102 still had considerable pinholes and low reversal sensitivity.

In contrast, Sample Nos. 103 to 116, which each contained one or two of preferred desensitizing dyes represented by formulae (I) and (II) were significantly reduced in pinhole generation by the use of a conductive layer.

In the samples of the present invention, reversal sensitivity increased and pinhole generation decreased in the order of Sample Nos. 104<106<108<110<112<114<116.

Combined use of desensitizing dyes as in Sample Nos. 114 and 116 gave especially satisfactory results.

Although use of a conductive layer is thought to be effective in diminishing pinholes, it is utterly surprising that this effect varies considerably depending on a combination of desensitizing dyes used, as in the present invention.

The amount of pinholes generated at various blackening densities was measured in completely the same manner. As a result, the effects of the present invention were observed at any blackening density.

TABLE 2

| Sample No. | Desensitizing dye | Presence or absence of conductive layer | $S_{0.2}$ | Surface resistivity (25° C., 25% RH) (Ω) | Amount of generated pinholes |
|---|---|---|---|---|---|
| 101 | H-2 | none | 100 (reference) | $10^{12}$ to $10^{13}$ | 100 (reference) |
| 102 | H-2 | present | 100 (reference) | $2 \times 10^8$ | 65 |
| 103 | I-1 | none | 229 | $10^{12}$ to $10^{13}$ | 101 |
| 104 | I-1 | present | 229 | $2 \times 10^8$ | 10 |
| 105 | I-37 | none | 234 | $10^{12}$ to $10^{13}$ | 101 |
| 106 | I-37 | present | 234 | $2 \times 10^8$ | 10 |
| 107 | II-51 | none | 251 | $10^{12}$ to $10^{13}$ | 100 |
| 108 | II-51 | present | 251 | $2 \times 10^8$ | 8 |
| 109 | II-17 | none | 275 | $10^{12}$ to $10^{13}$ | 101 |
| 110 | II-17 | present | 275 | $2 \times 10^8$ | 5 |
| 111 | II-44 | none | 295 | $10^{12}$ to $10^{13}$ | 100 |
| 112 | II-44 | present | 295 | $2 \times 10^8$ | 5 |
| 113 | I-1/II-44 | none | 347 | $10^{12}$ to $10^{13}$ | 99 |
| 114 | I-1/II-44 | present | 347 | $2 \times 10^8$ | 2 |
| 115 | I-37/II-44 | none | 355 | $10^{12}$ to $10^{13}$ | 100 |
| 116 | I-37/II-44 | present | 355 | $2 \times 10^8$ | 2 |

In Table 2, $S_{0.2}$ and the amount of generated pinholes were indicated as a relative value, with those of Sample No. 101 being 100.

Values of the amount of generated pinholes were those obtained at a blackening density of 1.

In Samples Nos. 113, 114, 115, and 116, the amount of each of desensitizing dyes I-1, I-37, and II-44 was 5 mg/m$^2$. The total dye amount in each of these samples was hence the same as the other samples.

H-2

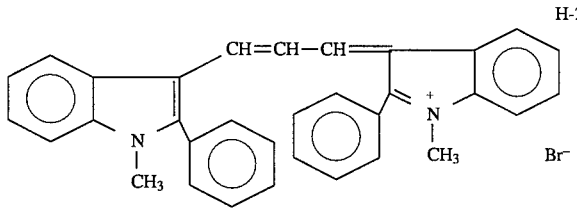

Also in samples having a conductive layer made from a material other than $SnO_2$, a considerable diminution of pinholes was observed when the desensitizing dyes of the present invention were used in combination with that conductive layer.

Example 3

A 100 μm-thick polyethylene terephthalate support undercoated on both sides was coated on one side with conductive layer (1) and dye layer (2) in this order by simultaneous coating, which layers respectively had the following compositions. Samples which did not have these layers were also prepared as comparative samples.

| | |
|---|---|
| (1) Conductive Layer | |
| Gelatin | 200 mg/m$^2$ |
| Proxel | 1 mg/m$^2$ |
| Surfactant 1 | 18 mg/m$^2$ |
| Sodium p-dodecylbenzenesulfonate | 23 mg/m$^2$ |
| $SnO_2$/Sb (9/1 by weight; average particle diameter 0.25 μm) | 330 mg/m$^2$ |
| (2) Dye Layer | |
| Gelatin | 2400 mg/m$^2$ |
| Proxel | 8 mg/m$^2$ |
| Dye 1 | 45 mg/m$^2$ |
| Dye 2 | 90 mg/m$^2$ |
| Surfactant 1 (described in Example 1) | 68 mg/m$^2$ |
| Sodium p-dodecylbenzenesulfonate | 20 mg/m$^2$ |
| 1,3-Vinylsulfonyl-2-propanol | 285 mg/m$^2$ |
| Strontium barium sulfate | 300 mg/m$^2$ |
| Liquid paraffin | 310 mg/m$^2$ |

Subsequently, the support was coated on the other side with emulsion layer (3) and protective layer (4) by simultaneous coating.

| | |
|---|---|
| (3) Emulsion Layer | |
| Emulsion (Ag amount) | 1300 mg/m$^2$ |
| Desensitizing dye | 10 mg/m$^2$ |
| KBr | 185 mg/m$^2$ |
| Sodium p-dodecylbenzenesulfonate | 56 mg/m$^2$ |
| Hardener, 1,3-vinylsulfonyl-2-propanol | 162 mg/m$^2$ |
| Gelatin | 1000 mg/m$^2$ |
| (4) Protective Layer | |
| Gelatin | 800 mg/m$^2$ |
| Proxel | 3 mg/m$^2$ |
| Strontium barium sulfate (average particle diameter, 1.5 μm) | 220 mg/m$^2$ |
| Liquid paraffin | 310 mg/m$^2$ |
| Surfactant 1 | 12 mg/m$^2$ |
| Sodium p-dodecylbenzenesulfonate | 5 mg/m$^2$ |
| Colloidal silica (Snowtex C, manufactured by Nissan Chemical Industries, Ltd.) | 140 mg/m$^2$ |

The samples were processed and evaluated in the same manner as in Example 2, except the following.

Exposure of the samples was conducted through a 633-nm interference filter (transmission density at 633 nm, 0.7; half band width, 15 nm) or by scanning exposure with an He-Ne laser.

Sharpness was also evaluated by the following method.

The samples were exposed in the same manner as in the sensitometric exposure, except that the step wedge was replaced with a wedge for MTF (modulation transfer function) measurement. The exposed samples were processed and subjected to density measurement. From each MTF curve (modulation transfer curve) thus obtained, the MTF values at spatial frequencies of 50 cycles and 100 cycles were determined. MT values closer to 1.0 indicate that the images are less apt to suffer deterioration (optical unsharpness), i.e., have high quality.

As is apparent from the results shown in Table 3, in the case of using desensitizing dye H-2, the conductive layer had the effect of reducing the amount of pinholes generated.

The dye layer had the effect of improving sharpness (Sample Nos. 201 to 204).

In the case of using either of desensitizing dyes II-44 and I-37, the conductive layer reduced pinhole generation and the dye layer improved sharpness (Sample Nos. 205 to 212).

In Sample Nos. 213 to 216, which contained desensitizing dyes II-44 and I-37 in combination, the pinhole-diminishing effect of the conductive layer and the sharpness-improving effect of the dye layer were produced far more remarkably. The reversal sensitivity thereof was even higher.

TABLE 3

| Sample No. | Desensitizing dye | Presence or absence of conductive layer | Dye 1 | Dye 2 | $S_{0.2}$ | Surface resistivity 25° C., 252% RH (Ω) | Amount of generated pinholes | $MT_1$ 50 c/mm | $MT_2$ 100 c/mm |
|---|---|---|---|---|---|---|---|---|---|
| 201 | H-2 | none | — | — | 100 (reference) | $10^{12}$ to $10^{13}$ | 100 (reference) | 0.81 | 0.71 |
| 202 | " | " | a-42 | III-8 | 91 | " | 101 | 0.84 | 0.75 |
| 203 | " | present | — | — | 100 | $1 \times 10^9$ | 55 | 0.81 | 0.71 |
| 204 | " | " | a-42 | III-8 | 91 | " | 56 | 0.84 | 0.75 |
| 205 | II-44 | none | — | — | 282 | $10^{12}$ to $10^{13}$ | 100 | 0.81 | 0.72 |
| 206 | " | " | a-42 | III-8 | 275 | " | 99 | 0.84 | 0.76 |
| 207 | " | present | — | — | 282 | $1 \times 10^9$ | 10 | 0.82 | 0.72 |
| 208 | " | " | a-42 | III-8 | 281 | " | 5 | 0.95 | 0.95 |
| 209 | I-37 | none | — | — | 245 | $10^{12}$ to $10^{13}$ | 100 | 0.81 | 0.72 |
| 210 | " | " | a-42 | III-8 | 240 | " | 99 | 0.84 | 0.76 |
| 211 | " | present | — | — | 245 | $1 \times 10^9$ | 13 | 0.81 | 0.72 |
| 212 | " | " | a-42 | III-8 | 243 | " | 7 | 0.93 | 0.93 |
| 213 | II-44/I-37 | none | — | — | 380 | $10^{12}$ to $10^{13}$ | 99 | 0.81 | 0.72 |

TABLE 3-continued

| Sample No. | Desensitizing dye | Presence or absence of conductive layer | Dye 1 | Dye 2 | $S_{0.2}$ | Surface resistivity 25° C., 252% RH (Ω) | Amount of generated pinholes | $MT_1$ 50 c/mm | $MT_2$ 100 c/mm |
|---|---|---|---|---|---|---|---|---|---|
| 214 | " | " | a-42 | III-8 | 372 | " | 99 | 0.84 | 0.76 |
| 215 | " | present | — | — | 380 | $1 \times 10^9$ | 8 | 0.81 | 0.72 |
| 216 | " | " | a-42 | III-8 | 380 | " | 2 | 0.97 | 0.97 |

In Sample Nos. 213 to 216, the amount of each of II-44 and I-37 was 5 mg/m$^2$.

Although it is thought that use of a conductive layer is effective in diminishing pinholes to some degree and use of a dye layer is effective in improving sharpness, it is utterly surprising that these effects vary considerably depending on a combination of specific desensitizing dyes used, as in the present invention.

While the invention has been described in detail and with reference to specific embodiments thereof, it will be apparent to one skilled in the art that various changes and modifications can be made therein without departing from the spirit and scope thereof.

What is claimed is:

1. A direct positive silver halide photographic material containing at least one compound represented by the following formula (I) and at least one cyanine dye having a pyrazolo[5,1-b]quinazolone nucleus and a 5- or 6-membered nitrogen-containing heterocyclic ring, wherein a carbon atom at the 3-position of the pyrazolo[5,1-b]quinazolone nucleus is bonded through a four-methine chain to an atom at the 2-position or 4-position of the 5- or 6-membered nitrogen-containing heterocyclic ring, provided that the 4-position is possible only when the 5- or 6-membered nitrogen-containing heterocyclic ring is a quinoline or pyridine nucleus:

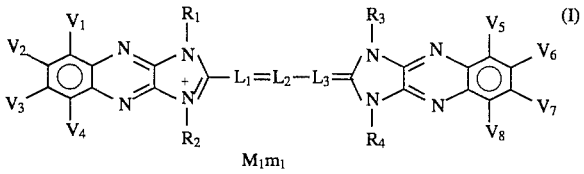

(I)

wherein $R_1$, $R_2$, $R_3$ and $R_4$ each represents an alkyl group, an aryl group or a heterocyclic group;

$V_1$, $V_2$, $V_3$, $V_4$, $V_5$, $V_6$, $V_7$ and $V_8$ each represents a hydrogen atom or a monovalent substituent selected from the group consisting of an alkyl group, an aryl group, a heterocyclic group, a halogen atom, a mercapto group, a cyano group, a carboxyl group, a sulfo group, a hydroxyl group, a carbamoyl group, a sulfamoyl group, an amino group, a nitro group, an alkoxy group, an aryloxy group, an acyl group, an acylamino group, a sulfonyl group, a sulfonylamino group, an alkylthio group, an arylthio group, an alkoxycarbonyl group and an aryloxycarbonyl group;

$L_1$, $L_2$ and $L_3$ each represents a methine group;

$M_1$ represents a charge-neutralizing counter ion; and $m_1$ is a number of 0 or larger necessary for intramolecular charge neutralization.

2. The direct positive silver halide photographic material as claimed in claim 1, wherein the cyanine dye having a pyrazolo[5,1-b]quinazolone nucleus is a dye represented by the following formula (II):

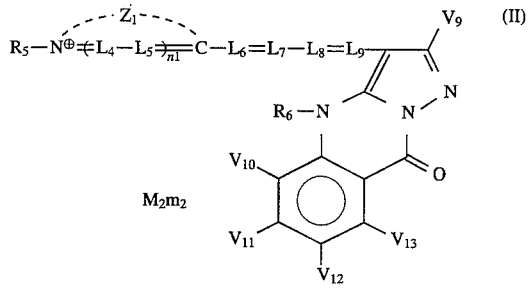

(II)

wherein $R_5$ and $R_6$ each has the same meaning as $R_1$, $R_2$, $R_3$ and $R_4$;

$V_9$, $V_{10}$, $V_{11}$, $V_{12}$ and $V_{13}$ each has the same meaning as $V_1$, $V_2$, $V_3$, $V_4$, $V_5$, $V_6$, $V_7$ and $V_8$;

$L_4$, $L_5$, $L_6$, $L_7$, $L_8$ and $L_9$ each has the same meaning as $L_1$, $L_2$ and $L_3$;

$Z_1$ represents an atomic group necessary for forming a 5- or 6-membered nitrogen-containing heterocyclic ring;

$M_2$ has the same meaning as $M_1$;

$m_2$ has the same meaning as $m_1$; and $n_1$ is 0 or 1.

3. The direct positive silver halide photographic material as claimed in claim 2, wherein the alkyl group represented by $R_5$ or $R_6$ is selected from the group consisting of an unsubstituted alkyl group and an alkyl group substituted by at least one of a carboxyl group, a sulfo group, a cyano group, a halogen atom, a hydroxyl group, an alkoxycarbonyl group, an alkanesulfonylaminocarbonyl group, an acylaminosulfonyl group, an alkoxy group, an alkylthio group, an aryloxy group, an acyloxy group, an acyl group, a carbamoyl group, a sulfamoyl group and an aryl group;

the aryl group represented by $R_5$ or $R_6$ is selected from the group consisting of an unsubstituted aryl group and an aryl group substituted by at least one of an alkyl group, an aryl group, a heterocyclic group, a halogen atom, a mercapto group, a cyano group, a carboxyl group, a sulfo group, a hydroxyl group, a carbamoyl group, a sulfamoyl group, an amino group, a nitro group, an alkoxy group, an aryloxy group, an acyl group, an acylamino group, a sulfonyl group, a sulfonylamino group, an alkylthio group, an arylthio group, an alkoxycarbonyl group and an aryloxycarbonyl group, which may be further substituted by one or more of an alkyl group, an alkenyl group, an aryl group, a hydroxyl group, a carboxyl group, a sulfo group, a nitro group, a cyano group, a halogen atom, an alkoxy group, an aryloxy group, an alkoxycarbonyl group, an acyl group, an acylamino group, a sulfonamino group, a carbamoyl group and a sulfamoyl group; and the heterocyclic group represented by $R_5$ or $R_6$ is selected from the group consisting of an unsubstituted heterocyclic group and a heterocyclic group substituted by at least one of an alkyl group, an aryl group, a heterocyclic group, a halogen atom, a mercapto group, a cyano group, a carboxyl group, a sulfo group, a hydroxyl group, a carbamoyl group, a sulfamoyl group, an amino group, a nitro group, an alkoxy group, an aryloxy group, an acyl group, an acylamino group, a sulfonyl group, a sulfonylamino group, an alkylthio group, an arylthio group, an alkoxycarbonyl group and an aryloxycarbonyl group, which may be further substituted by one or more of an alkyl group, an alkenyl group, an aryl group, a hydroxyl group, a carboxyl group, a sulfo group, a nitro group, a cyano group, a halogen atom, an alkoxy group, an aryloxy group, an alkoxycarbonyl group, an acyl group, an acylamino group, a sulfonamino group, a carbamoyl group and a sulfamoyl group.

4. The direct positive silver halide photographic material as claimed in claim 2, wherein the monovalent substituent represented by $V_9$, $V_{10}$, $V_{11}$, $V_{12}$ or $V_{13}$ is further substituted by one or more of an alkyl group, an alkenyl group, an aryl group, a hydroxyl group, a carboxyl group, a sulfo group, a nitro group, a cyano group, a halogen atom, an alkoxy group, an aryloxy group, an alkoxycarbonyl group, an acyl group, an acylamino group, a sulfonamino group, a carbamoyl group and a sulfamoyl group.

5. The direct positive silver halide photographic material as claimed in claim 2, wherein the methine group represented by $L_4$, $L_5$, $L_6$ $L_7$, $L_8$ or $L_9$ is selected from the group consisting of an unsubstituted methine group and a methine group substituted by an alkyl group, an aryl group, a heterocyclic group, a halogen atom, an alkoxy group, an amino group or an alkylthio group.

6. The direct positive silver halide photographic material as claimed in claim 1, which comprises a support having thereon an electrically conductive layer.

7. The direct positive silver halide photographic material as claimed in claim 1, which contains at least one water-soluble dye.

8. The direct positive silver halide photographic material as claimed in claim 1, which contains silver halide emulsion having a grain size of from 0.06 μm to 0.12 μm.

9. The direct positive silver halide photographic material as claimed in claim 1, which is a photographic material for He-Ne laser exposure.

10. The direct positive silver halide photographic material as claimed in claim 1, wherein the alkyl group represented by $R_1$, $R_2$, $R_3$ or $R_4$ is selected from the group consisting of an unsubstituted alkyl group and an alkyl group substituted by at least one of a carboxyl group, a sulfo group, a cyano group, a halogen atom, a hydroxyl group, an alkoxycarbonyl group, an alkanesulfonylaminocarbonyl group, an acylaminosulfonyl group, an alkoxy group, an alkylthio group, an aryloxy group, an acyloxy group, an acyl group, a carbamoyl group, a sulfamoyl group and an aryl group;

the aryl group represented by $R_1$, $R_2$, $R_3$ or $R_4$ is selected from the group consisting of an unsubstituted aryl group and an aryl group substituted by at least one of an alkyl group, an aryl group, a heterocyclic group, a halogen atom, a mercapto group, a cyano group, a carboxyl group, a sulfo group, a hydroxyl group, a carbamoyl group, a sulfamoyl group, an amino group, a nitro group, an alkoxy group, an aryloxy group, an acyl group, an acylamino group, a sulfonyl group, a sulfonylamino group, an alkylthio group, an arylthio group, an alkoxycarbonyl group and an aryloxycarbonyl group, which may be further substituted by one or more of an alkyl group, an alkenyl group, an aryl group, a hydroxyl group, a carboxyl group, a sulfo group, a nitro group, a cyano group, a halogen atom, an alkoxy group, an aryloxy group, an alkoxycarbonyl group, an acyl group, an acylamino group, a sulfonamino group, a carbamoyl group and a sulfamoyl group; and the heterocyclic group represented by $R_1$, $R_2$, $R_3$ or $R_4$ is selected from the group consisting of an unsubstituted heterocyclic group and a heterocyclic group substituted by at least one of an alkyl group, an aryl group, a heterocyclic group, a halogen atom, a mercapto group, a cyano group, a carboxyl group, a sulfo group, a hydroxyl group, a carbamoyl group, a sulfamoyl group, an amino group, a nitro group, an alkoxy group, an aryloxy group, an acyl group, an acylamino group, a sulfonyl group, a sulfonylamino group, an alkylthio group, an arylthio group, an alkoxycarbonyl group and an aryloxycarbonyl group, which may be further substituted by one or more of an alkyl group, an alkenyl group, an aryl group, a hydroxyl group, a carboxyl group, a sulfo group, a nitro group, a cyano group, a halogen atom, an alkoxy group, an aryloxy group, an alkoxycarbonyl group, an acyl group, an acylamino group, a sulfonamino group, a carbamoyl group and a sulfamoyl group.

11. The direct positive silver halide photographic material as claimed in claim 1, wherein the monovalent substituent represented by $V_1$, $V_2$, $V_3$, $V_4$, $V_5$, $V_6$, $V_7$ or $V_8$ is further substituted by one or more of an alkyl group, an alkenyl group, an aryl group, a hydroxyl group, a carboxyl group, a sulfo group, a nitro group, a cyano group, a halogen atom, an alkoxy group, an aryloxy group, an alkoxycarbonyl group, an acyl group, an acylamino group, a sulfonamino group, a carbamoyl group and a sulfamoyl group.

12. The direct positive silver halide photographic material as claimed in claim 1, wherein the methine group represented by $L_1$, $L_2$ or $L_3$ is selected from the group consisting of an unsubstituted methine group and a methine group substituted by an alkyl group, an aryl group, a heterocyclic group, a halogen atom, an alkoxy group, an amino group or an alkylthio group.

* * * * *